US005744909A

United States Patent [19]

Amano

[11] Patent Number: 5,744,909

[45] Date of Patent: Apr. 28, 1998

[54] DISCHARGE DISPLAY APPARATUS WITH MEMORY SHEETS AND WITH A COMMON DISPLAY ELECTRODE

[75] Inventor: Yoshifumi Amano, Kamakura, Japan

[73] Assignee: Technology Trade and Transfer Corporation, Kanagawa, Japan

[21] Appl. No.: 489,035

[22] Filed: Jun. 9, 1995

[30] Foreign Application Priority Data

Jul. 7, 1994 [JP] Japan ..... 6-156024

[51] Int. Cl.[6] ..... H01J 17/49

[52] U.S. Cl. ..... 313/585; 313/586; 313/250; 313/259; 345/60; 345/185

[58] Field of Search ..... 313/581, 584, 313/585, 586, 587, 250, 257, 258, 259, 288, 292; 345/60, 74, 76, 185, 192

[56] References Cited

U.S. PATENT DOCUMENTS 4,999,541 3/1991 Kim et al. ..... 313/585 X
5,175,473 12/1992 Kim ..... 313/585 X
5,260,624 11/1993 Kim et al. ..... 313/585 X
5,440,201 8/1995 Martin et al. ..... 313/584 X

FOREIGN PATENT DOCUMENTS 61-273832 12/1986 Japan .
6130913 5/1994 Japan .
6314545 11/1994 Japan .
845433 2/1996 Japan .

*Primary Examiner*—Ashok Patel
*Attorney, Agent, or Firm*—Bauer & Schaffer

[57] ABSTRACT

A discharge display apparatus includes a plurality of first address electrodes (1) and a plurality of second address electrodes (2) both of which are disposed adjacent to each other so as to cross each other through a partition (6) and memory electrodes (3, 4) which have a plurality of apertures provided therethrough and are entirely covered with respective insulating layers (3*a*, 4*a*). The plurality of first and second address electrodes (1, 2) and the memory electrode (3, 4) are successively laminated and sealed into a tube body having discharge gas.

11 Claims, 13 Drawing Sheets

Voltage on Address Electrode 1 (Image Signal)
200V
100V

Voltage on Address Electrode 2 (Scan Signal)
100V
0V
100V
0V
100V
0V

Voltage on Memory Electrode 3
150V
100V
50V

Voltage on Memory Electrode 4
150V
100V
50V
Address Period
Memory Period

Voltage on Address Electrode 1 (Image Signal)

Voltage on Address Electrode 2 (Scan Signal)

Voltage on Memory Electrode 3
Voltage on Memory Electrode 4

Voltage on Memory Electrode 3
Voltage on Memory Electrode 4

Voltage on Display Anode 5
Period
Reset Period
Address Period
Memory Period

DISCHARGE DISPLAY APPARATUS WITH MEMORY SHEETS AND WITH A COMMON DISPLAY ELECTRODE

BACKGROUND OF THE INVENTION

1. Field of the Invention

The present invention relates to a discharge display apparatus in which a memory electrode is used.

2. Description of the Related Art

Some examples of a discharge display apparatus (PDP: plasma display panel) will hereinafter be described.

EXAMPLE 1 (shown in FIG. 1)

A discharge display apparatus (a memory electrode PDP) (Example 1) proposed by this assignee in Japanese Patent Application No. 74603/1992, Japanese Patent Application No. 300266/1992 and so on will be described with reference to FIG. 1. A body having a structure described later on is housed in a tube body formed by sealing peripheries of a front glass plate (not shown) and a rear glass plate 11 with a frit glass. After a vacuum is produced in the tube body, a discharge gaseous substance (gas) such as helium, neon, argon, xenon or the like, or a gaseous substance made by mixing them is sealed into the tube body.

This discharge display apparatus has a plurality of apertures arranged in a XY matrix fashion. The discharge display apparatus has two sheet-shaped memory electrodes 3, 4 entirely covered with insulating layers 3*a*, 4*a*, respectively. The two memory electrodes 3, 4 are overlappingly deposited such that the respective apertures of both of the memory electrodes 3, 4 are connected to form discharge cells. The memory electrodes 3, 4 are disposed in parallel to each other. A plurality of first address electrodes 1 and a plurality of second address electrodes 2 (one of them and the other thereof are employed as an anode and a cathode, respectively) both of which are disposed in a striped fashion and in parallel to each other are arranged in the XY matrix fashion and disposed so as to cross each other with a predetermined interval. Between the plurality of the first and second address electrodes 1, 2, a pair of the two overlappingly deposited memory electrodes 3, 4 are disposed such that respective intersection points thereof correspond to the discharge cells. The address electrodes 1, 2 and the memory electrodes 3, 4 are sealed into the tube body having the discharge gas. A predetermined voltage is applied to across selected first and second electrodes 1, 2 of the plurality of first and second address electrodes 1, 2 and a discharge is produced in a discharge cell (discharge space) positioned at an intersection point of the selected first and second electrodes 1, 2. A predetermined AC voltage is applied across a pair of the two memory electrodes 3, 4 to maintain the discharge.

An operation of the discharge display apparatus will be described. Initially, when the discharge is produced between the first address electrode (anode) 1 and the second address electrode (cathode) 2 by a discharge excited by writing an image signal in the discharge cell, charged particles, such as ions, electrons or the like, in the tube body are drawn into the apertures of the memory electrodes 3, 4 in response to polarities of the two memory electrodes 3, 4 produced by the applied AC voltage and accumulated on the inner surfaces of the insulating layers 3*a*, 4*a* of the apertures to form wall charges. Thereafter, when the polarities of the two memory electrodes are inverted by the applied AC voltage, a potential difference between the memory electrodes 3, 4 becomes large because a voltage based on the wall charges is superposed on the applied AC voltage. Thus, the discharge is produced in each of the apertures of the two memory electrodes 3, 4. Thereafter, this phenomenon is repeatedly produced so that the discharge produced by writing the signal in the discharge cell is maintained in the discharge cell formed of the aperture. In short, an auxiliary discharge selectively produced at the intersection point of the first and second address electrodes 1, 2 is transferred to a pair of the two memory electrodes 3, 4, thereby continuously emitting light only with a maintaining pulse.

According to the discharge display apparatus shown in FIG. 1, similarly to electrodes of a DC type PDP, the plurality of first and second address electrodes (anodes and cathodes) 1, 2 do not need to have the insulating layers formed thereon and the discharge is produced in the apertures provided through the memory electrodes 3, 4. Thus, basically, it is unnecessary to provide partitions (barrier ribs). The same drive circuit as that of the DC type PDP can be used. Therefore, the discharge display apparatus has a simple structure and is excellent in mass production. It is easy to make the discharge display apparatus higher in resolution and larger in size. It is easy to drive the discharge display apparatus so that its drive circuit can be simplified in arrangement. Moreover, it is easy to reduce costs of the discharge display apparatus.

EXAMPLE 2 (shown in FIG. 2)

A conventional discharge display apparatus (three electrode plane discharge type PDP) (Example 2) will be described with reference to FIG. 2. A body having a structure described later on is housed in a tube body formed by sealing peripheries of a front glass plate (not shown) and a rear glass plate 11 with a frit glass. After a vacuum is produced in the tube body, a discharge gaseous substance (gas) such as helium, neon, argon, xenon or the like, or a gaseous substance made by mixing them is sealed into the tube body.

On the rear glass plate 11, plural pairs of memory electrodes disposed in parallel to each other, i.e., memory electrodes (X1 electrodes) 2 and memory electrodes (X2 electrodes) 2' used also as an address electrode both of which are disposed in a striped fashion, are disposed in parallel to each other. An insulating layer 9 is deposited on an entire surface of the rear glass plate 11 and the plural pairs of the X1 electrodes 2 and the X2 electrodes 2'. A plurality of partitions 6 are provided on the insulating layer 9 so as to cross the plural pairs of the memory electrodes (X2 electrodes) 2 and the memory electrodes (X2 electrodes) 2' at right angles. On the respective partitions 6, a plurality of address electrodes (electrodes Y) 1 shaped in a striped fashion are disposed so as to cross the plural pairs of the memory electrodes (X2 electrodes) 2 and the memory electrodes (X2 electrodes) 2' at right angles and so as to be parallel to each other.

An operation of the discharge display apparatus shown in FIG. 2 will described. Initially, when a discharge is produced between the address electrodes (Y electrodes) 1 and the address electrodes (X2 electrodes) 2' to excite a discharge produced by writing an image signal in discharge cells, charges generated at this time are accumulated as so-called wall charges on the insulating layer 9 on the memory electrodes 2, 2'. In short, an address discharge is transferred to a memory discharge which is to be maintained.

EXAMPLE 3 (shown in FIG. 3)

A discharge display apparatus (Townsend discharge pulsed memory type PDP) (see Japanese Laid-open Patent Publication No. 273832/1986 (Japanese Patent Application No. 114078/1985) (Example 3) will be described with reference to FIG. 3. According to this discharge display apparatus, a discharge space is divided into two and an address discharge (auxiliary discharge) having a short discharge interval is produced in a lower portion of a discharge cell where a display is not carried out. The address discharge is then transferred to a memory discharge (display discharge) having a relatively long discharge interval, thereby improving radiative efficiency.

A body having a structure described later on is housed in a tube body formed by sealing peripheries of a front glass plate 12 and a rear glass plate 11 with a frit glass. After a vacuum is produced in the tube body, a discharge gaseous substance (gas) such as helium, neon, argon, xenon or the like, or a gaseous substance made by mixing them is sealed into the tube body.

A resistance layer 15 is deposited on the rear glass plate 11. A spacer 8*f* is deposited on the resistance layer 15. A plurality of address electrodes (cathodes) 13 shaped in a striped fashion are deposited on the spacer 8*f* in parallel to each other at predetermined intervals. Spacers 8*b* to 8*e* are successively laminated on the spacer 8*f* and the address electrodes 13 in reverse alphabetical order and an auxiliary discharge space 10' is formed on the spacer 8*f* so as to be pierced through the spacers 8*b* to 8*e*. The resistance layer 15 is connected to the memory in series. A plurality of auxiliary anodes 14 (address electrodes) are formed on a lower surface of the spacer 8*b* in the auxiliary discharge space 10' and disposed in parallel to each other at predetermined intervals so as to cross the plurality of cathodes 13.

A spacer 8*a* which is thicker as compared with the spacers 8*b* to 8*e* is deposited on the spacer 8*b*. A display discharge space 10 connected to the auxiliary discharge space 10' is provided through the spacer 8*a*. A fluorescent layer 7 is deposited on an inner wall of the display discharge space 10. The front glass plate 12 is provided so as to be opposed to an upper surface of the spacer 8*a*. A transparent display anode 5 is deposited on an entire lower surface of the front glass plate 12.

An operation of the discharge display apparatus of the example 3 will be described. When a predetermined DC voltage is applied between the auxiliary anode 14 and the cathode 13, both of which are selected in response to an image signal, of the plurality of auxiliary anodes 14 and the plurality of cathodes 13, an address discharge is produced in the auxiliary discharge space 10'. When a voltage is applied to the display anode 5 thereafter, a discharge path is shifted to a portion between the display anode 5 and the cathode 13.

In this case, the address discharge has only a function of an auxiliary discharge for exciting a memory discharge and does not have a memory function. In order to carry out a memory operation, there is employed a so-called pulsed memory system in which a pulsed voltage with an extremely high voltage, e.g., 500 V or higher and with a pulse width of 0.5 μsec or less is applied to the display anode 5 intermittently. Accordingly, in this case, a drive circuit becomes very complicated and expensive.

If the memory electrode type discharge display apparatus of the example 1 described with reference to FIG. 1 is arranged as a color discharge display apparatus by providing fluorescent layers of three primary colors at its necessary portion, then it is necessary to improve efficiency and luminance of light emission of the florescent layers and to improve contrast of a display carried out by the light emission.

Not only in the PDP but also in a gas discharge tube, similarly to a fluorescent lamp, a discharge path in the discharge space is set longer and fluorescent layers of the three primary colors are deposited at a portion adjacent to the discharge space, whereby ultraviolet rays are efficiently generated from a positive column generated in the discharge space, being efficiently applied to the fluorescent layers. Thus, it is possible to realize the light emission with high efficiency and high luminance.

However, if the discharge path is set longer in the discharge display apparatus of the example 1, then a discharge voltage should be increased, which causes the problem of driving the apparatus.

In the memory electrode type discharge display apparatus of the example 1, similarly to the AC type PDP, a so-called reset discharge for returning a screen obtained by the memory discharge to its initial state for preparation of writing a next screen is produced by an entire discharge between both of the memory electrodes. As long as the memory discharge is a main light source of the light emission, it is impossible to improve the contrast drastically.

Moreover, since the memory electrode type discharge display apparatus of example 1 has the memory electrodes disposed between a pair of the address electrodes forming the XY matrix, a distance between a pair of the address electrodes, i.e., between the anode and the cathode is determined by a thickness of the memory electrodes. Therefore, it is difficult to set an optimum distance between the electrodes for the address discharge. Potentials of the memory electrodes function to prevent the address discharge so that the voltage of the address discharge tends to be increased. This tendency becomes more remarkable as a diameter of the aperture of the memory electrodes becomes smaller, preventing improvement of the resolution.

While it is sometimes attempted as an effective means for increasing the efficiency as the discharge tube that the diameters of the apertures of the memory electrodes are set as small as possible to utilize a hollow effect, the address voltage becomes higher in the memory electrode type discharge display apparatus of the example 1 as the diameter of the aperture becomes smaller. Hence, the efficiency is actually prevented from being improved.

Moreover, since the respective apertures of the two memory electrodes should correspond to each other at 1:1 in the memory electrode type discharge display apparatus of the example 1, it is difficult to match the positions of the apertures.

Since the memory discharge is produced between a pair of the memory electrodes disposed adjacent to and in parallel to each other in the three-electrode plane discharge type discharge display apparatus (PDP) of the example 2, it is impossible to set the long discharge path. Therefore, it is impossible to improve the efficiency and luminance of the light emission drastically. In the three-electrode plane discharge type discharge display apparatus, similarly to the AC type PDP and the above-mentioned memory electrode discharge display apparatus of the example 1, the so-called reset discharge for returning the screen obtained by the memory discharge to its initial state for preparation of writing the next screen is produced by an entire discharge once between both of the memory electrodes. As long as the memory discharge is a main light source of the light emission, it is impossible to improve the contrast drastically.

According to the Townsend discharge pulsed memory type discharge display apparatus (PDP) of the example 3 described with reference to FIG. 3, the address discharge therein has only the function of the auxiliary discharge for exciting the memory discharge and does not have the memory function. In order to carry out the memory operation, there is employed the so-called pulsed memory system in which a pulse with the extremely high voltage (e.g., 500 V or higher) and with the extremely short pulse width (e.g., 0.5 μsec or less) is applied to the display anode 5 intermittently. Therefore, a drive circuit becomes very complicated and hence the apparatus becomes expensive.

SUMMARY OF THE INVENTION

In view of such aspects, a first object of the present invention is to propose a discharge display apparatus which can realize high luminance and high efficiency with simple arrangement and circuit and in which an address discharge and a memory discharge are not interfered by a relation between voltages applied to an address electrode and a memory electrode so that an optimum voltage can be selected.

A second object of the present invention is to propose a discharge display apparatus which can separate a memory discharge and a main discharge, i.e., a discharge that contributes to display based on light emission with simple arrangement and a simple drive method to thereby improve contrast and the efficiency of the light emission and the luminance.

According to a first aspect of the present invention, a discharge display apparatus comprises a plurality of first address electrodes and a plurality of second address electrodes both of which are disposed adjacent to each other so as to cross each other through a partition and memory electrodes which have a plurality of apertures provided therethrough and are entirely covered with respective insulating layers. The plurality of first and second address electrodes and the memory electrode are successively laminated and sealed into a tube body having discharge gas.

According to a second aspect of the present invention, a discharge display apparatus comprises a plurality of first address electrodes and a plurality of second address electrodes both of which are disposed adjacent to each other so as to cross each other through a partition, memory electrodes which have a plurality of apertures provided therethrough and are entirely covered with respective insulating layers, a spacer which has a plurality of apertures respectively corresponding to the plurality of apertures of the memory electrodes and in which a fluorescent layer is deposited on inner walls of the plurality of apertures, and a common electrode. The plurality of first and second address electrodes, the memory electrodes, the spacer and the common electrode are successively laminated and sealed into a tube body having discharge gas.

According to a third aspect of the present invention, a discharge display apparatus comprises a plurality of first address electrodes and a plurality of second address electrodes both of which are disposed adjacent to each other so as to cross each other through a partition, memory electrodes which have a plurality of apertures provided therethrough and are entirely covered with respective insulating layers, a spacer which has a plurality of apertures respectively corresponding to the plurality of apertures of the memory electrodes and in which a fluorescent layer is deposited on a surface on the opposite side of the memory electrodes, and a common electrode. The plurality of first and second address electrodes, the memory electrodes, the spacer and the common electrode are successively laminated and sealed into a tube body having discharge gas.

According to a fourth aspect of the present invention, in the discharge display apparatus according to the first, second or third aspect of the present invention, a plurality of apertures of the memory electrodes are opposed to each of lattice apertures formed by the plurality of first address electrodes and the plurality of second address electrodes.

According to a fifth aspect of the present invention, in the discharge display apparatus according to the first, second, third or fourth aspect of the present invention, the memory electrode is used as the partition and the plurality of first address electrodes and the plurality of second address electrodes are deposited on insulating layers on both of surfaces thereof.

According to a sixth aspect of the present invention, a discharge display apparatus comprises plural pairs of first memory electrodes and second address electrodes serving also as second memory electrodes both of which are disposed adjacent to each other and deposited on an insulating layer, a plurality of first address electrodes which cross the plurality of second address electrodes through the insulating layer and a partition, a spacer which has a plurality of apertures respectively corresponding to the plurality of apertures formed by the plurality of first address electrodes and the plurality of second address electrodes and in which a fluorescent layer is deposited on inner walls of the plurality of apertures, and a common electrode. The plural pairs of first and second memory electrodes both of which are disposed adjacent to each other and deposited on the insulating layer, the plurality of first address electrodes, the spacer and the common electrode are successively laminated and sealed into a tube body having discharge gas.

DESCRIPTION OF THE PREFERRED EMBODIMENTS

Figure 1:
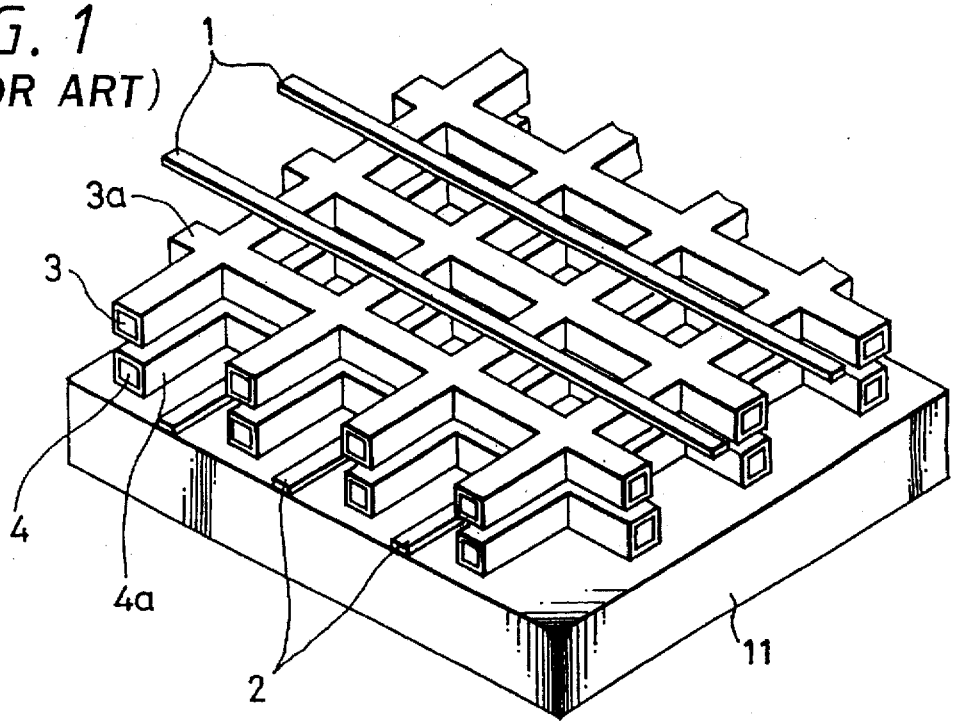
FIG. 1 (PRIOR ART)
FIG. 1 is a perspective view showing a discharge display apparatus according to an example 1.
Figure 2:
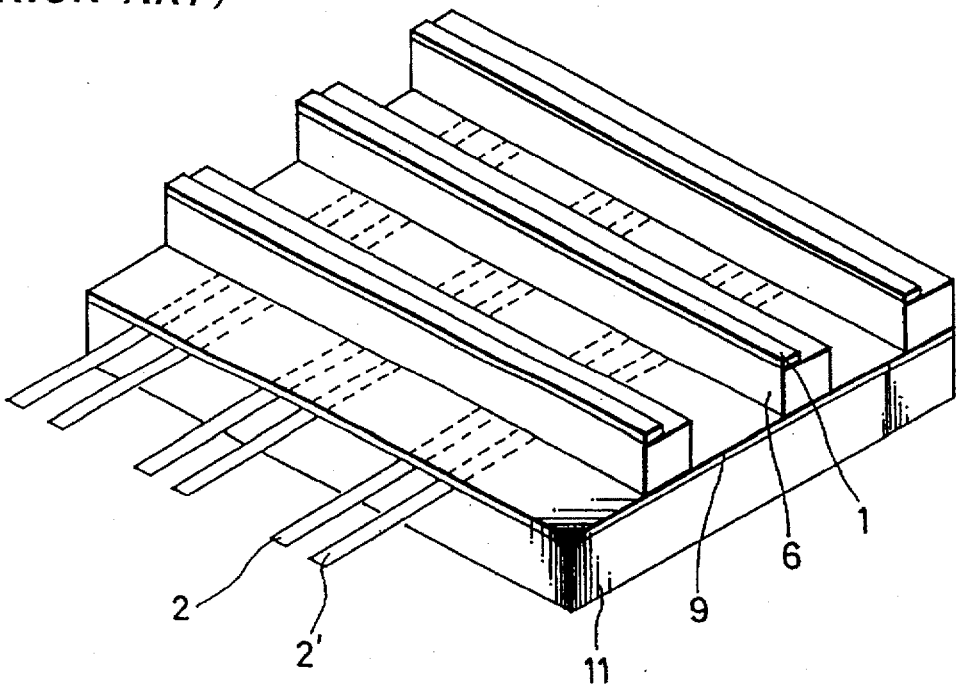
FIG. 2 (PRIOR ART)
FIG. 2 is a perspective view showing a discharge display apparatus according to an example 2.
Figure 3:
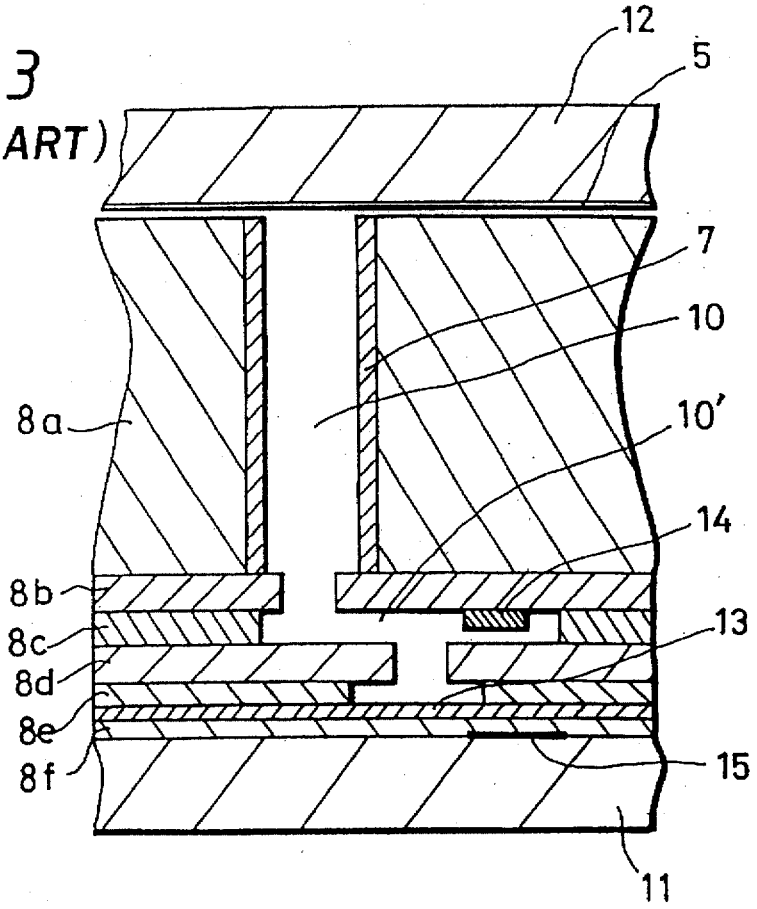
FIG. 3 (PRIOR ART)
FIG. 3 is a cross-sectional view showing a discharge display apparatus according to an example 3.

Each of embodiments according to the present invention will be described with reference to the drawings. First embodiment (shown in FIGS. 4 through 7)

A first embodiment according to the present invention will be described with reference to FIGS. 4 and 5 which respectively show a perspective view and a cross-sectional view of a main part of a discharge display apparatus. The discharge display apparatus is a PDP arranged such that a body having a structure described later on is housed in a tube body formed by sealing peripheries of a front glass plate 12 and a rear glass plate 11 with a frit glass and that after a vacuum is produced in the tube body, a discharge gaseous substance (gas) (200 torr to 400 torr), such as helium, neon, argon, xenon or the like or a mixed gaseous substance made thereof, is sealed into the tube body.

A plurality of address electrodes (X electrodes) 2 of a stripe shape are disposed in parallel to each other at predetermined intervals and deposited on the rear glass plate 11. The address electrodes 2 can be deposited with ease by a thick-film technology, such as a screen printing method or the like, or a thin-film technology, such as a photo process or the like. A plurality of partitions (made of an insulator) 6 of a stripe-shape are disposed in parallel to each other at constant intervals so as to cross the plurality of address electrodes 2 at substantially right angles and deposited on the rear glass plate 11 and the address electrodes 2. The plurality of partitions 6 each having a predetermined height can be obtained by repeatedly effecting the screen printing. A plurality of address electrodes (Y electrodes) 1 of a stripe-shape are respectively deposited on the plurality of partitions 6. The address electrodes 1 are deposited similarly to the address electrodes 2. Thus, the plurality of address electrodes 1, 2 are disposed so as to cross each other at substantially right angles with a predetermined interval.

A thickness of each of the partitions 6 is set optimum in consideration of a gas pressure, gas composition, a pixel pitch and so on, generally set substantially within the range from 80 μm to 200 μm. The partitions 6 may be formed in a lattice fashion in order to reliably avoid a crosstalk between adjacent pixels.

Any of the plurality of address electrodes 1, 2 may be used as the anodes or the cathodes. Since it is necessary to produce the discharge from any one side of the plurality of partitions 6, the plurality of address electrodes 1 disposed on the upper side of the plurality of partitions 6 man be covered at their one sides with insulating layers therefor.

A pair of lattice-shaped memory electrodes 3, 4 are entirely covered with insulating layers 3*a*, 4*a*, respectively. The two memory electrodes 3, 4 are made of conductive layers having a plurality of rectangular apertures (lattice apertures) disposed in a matrix fashion, i.e., a mesh-shaped conductive plate formed by etching a plate made of metal, such as stainless steel, aluminum, nickel or the like, or alloy thereof or the like. A paste made of glass powders, for example, is coated on the entire surfaces of the memory electrodes 3, 4 by spraying, soaking or the like and fired at high temperature to form the insulating layers 3*a*, 4*a*. The insulating layers 3*a*, 4*a* may be formed by oxidizing the surfaces of the memory electrodes 3, 4 made of the above metals or alloy themselves.

The two memory electrodes 3, 4 are set in shape and opposing position so that their lattices should correspond to the address electrodes 1, 2, respectively. The front glass plate 12 is disposed on the upper side memory electrode 3. The two memory electrodes 3, 4 can have apertures shaped into not only a square or a rectangle but also a circle or an ellipse and so on.

The address electrodes 1, 2 and the memory electrodes 3, 4 are positioned such that square or rectangular apertures formed by intersection of the plurality of address electrodes 1, 2 and the apertures of the two memory electrodes 3, 4 are connected to each other to form discharge spaces 10. A fluorescent layer 7 is deposited on portions of the front glass plate 12 which are opposed to the respective discharge spaces 10. The fluorescent layer 7 is a single-colored fluorescent layer or fluorescent layers of red, green and blue which are successively and repeatedly disposed in the horizontal and/or vertical direction.

Subsequently, an operation of the discharge display apparatus of the first embodiment will be described briefly. When a DC voltage sufficient for discharge is applied between the first and second address electrodes 1, 2, which are selected in response to an image signal, of the plurality of the first and second address electrodes 1, 2, a potential of the discharge space 10 in a plasma state in which the discharge space 10 fills with ions, electrons or metastable atoms substantially becomes a voltage at which a discharge to the cathode of the first and second address electrodes 1, 2 is maintained. In such state, polarities and amounts of charges accumulated on surfaces of the insulating layers 3*a*, 4*a* of the memory electrodes 3, 4 are changed depending upon whether the respective potentials of the memory electrodes 3, 4 are both maintained at higher or lower levels as compared with a plasma potential. Specifically, when the potentials of the memory electrodes 3, 4 are maintained at the higher potential during the address discharge, negative space charges, i.e., electrons are attracted to the surfaces of the insulating layers 3*a*, 4*a* of the memory electrodes 3, 4 and accumulated thereon as wall charges. When the potentials of the memory electrodes 3, 4 are maintained at the lower potential during the address discharge, positive space charges, i.e., ions are attracted to the surfaces of the insulating layers 3*a*, 4*a* and accumulated thereon as the wall charges. An amount of the wall charges to be accumulated is determined by difference between the potentials of the memory electrodes 3, 4 and the plasma potential, a dielectric constant the insulating layers 3*a*, 4*a*, thicknesses thereof and so on.

In order to store the wall charges generated by the address discharge between the first and second address electrodes 1, 2 in the memory electrodes 3, 4 as position information based on an image signal, it is sufficient, for example, to maintain one of the two memory electrodes 3, 4 at the higher level and the other thereof at the lower level during the address discharge. Specifically,the wall charges are formed on a wall surface of a pixel, i.e., the discharge space 10 where the address discharge is produced. The wall charges are not formed on a pixel, i.e., the discharge space 10 where the address discharge is not produced. Therefore, a pulse for maintaining the discharge is applied to the memory electrodes 3, 4 after the address period is finished, thereby displaying an image. Until the next address discharge, the display is maintained as a memory display. When the potentials of the memory electrodes 3, 4 are set at the same potential, e.g., the same potential as the plasma potential, the wall charges at present are erased by the space charges because potential difference between both of the memory electrodes 3, 4 is 0. Even by such method, the image information can be accumulated on the memory electrodes 3, 4 in the form of distribution state of the wall charges.

An operation of the discharge display apparatus of the first embodiment will be described in detail with reference to FIGS. 6 and 7. Initially, a drive method thereof shown in FIG. 6 will be described. When the discharge display apparatus is driven, it is necessary that there is no wall charge on each of the surfaces of the insulating layers 3*a*, 4*a* of the lattice apertures of the memory electrodes 3, 4. Accordingly, when the discharge display apparatus is driven, the wall charges of all the discharge cells on a screen or on a line are erased by some proper processings, such as to produce the discharge for erasure of the wall charges before an address signal is applied. A specific method of erasing the wall charges is as follows. In a state that the address signal is not applied to the address electrodes 1, 2, a sufficient voltage is applied to the memory electrodes 3, 4 to produce the discharge in all the discharge cells on the screen or on the line. Immediately thereafter, the potentials of the memory electrodes 3, 4 are maintained at the same voltage as the discharge space potential, whereby the wall charges disappear and new wall charges are prevented from being accumulated.

Figures 6A, 6B, 6C, 6D:
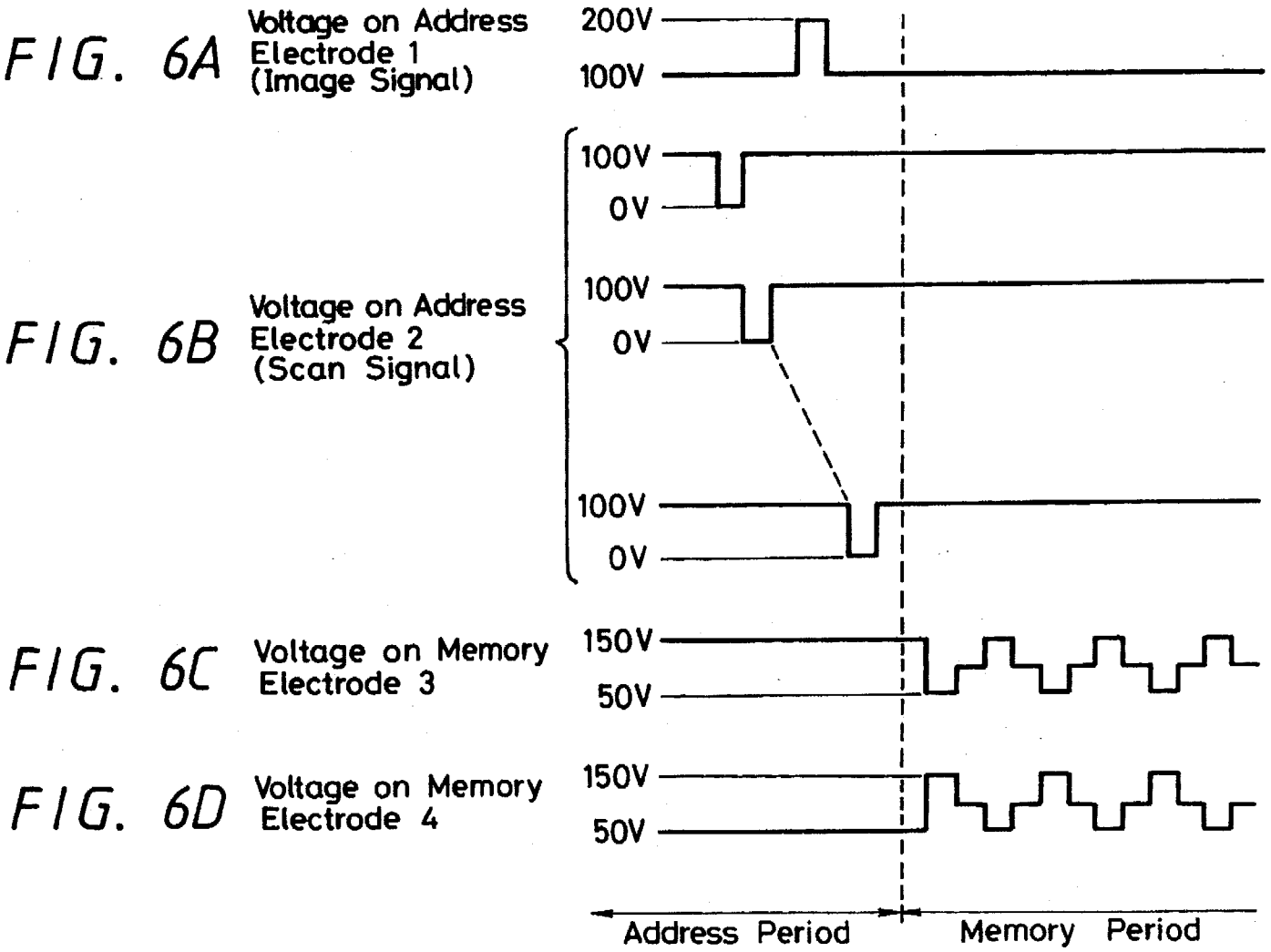
FIG. 6A is a timing chart with respect to a voltage (image signal) on an address electrode 1 used to explain an operation of the discharge display apparatus according to the first embodiment.
FIG. 6B is a timing chart with respect to a voltage (scanning signal) on an address electrode 2 used to explain the operation of the discharge display apparatus according to the first embodiment.
FIG. 6C is a timing chart with respect to a voltage on a memory electrode 3 used to explain the operation of the discharge display apparatus according to the first embodiment.
FIG. 6D is a timing chart with respect to a voltage on a memory electrode 4 used to explain the operation of the discharge display apparatus according to the first embodiment.

In a state that there is no wall charge, as shown in FIGS. 6C and D, a voltage higher than the discharge space potential (e.g., 100V), e.g., a voltage of 150V is applied to the memory electrode 3 and a voltage lower than the discharge space potential, e.g., a voltage of 50V is applied to the memory electrode 4. In such a state, as shown in FIG. 6A, a positive voltage which is 200V sufficient for the address discharge is applied to the address electrode 1 and also, as shown in FIG. 6B, a ground potential is applied to the address electrode 2. Negative charges generated by the address discharge are charged on the insulating layer 3*a* deposited on the memory electrode 3 as the wall charges and positive charges are charged on the insulating layer 4*a* deposited on the memory electrode 4 as the wall charges. Then, the voltage applied to the address electrode 1 is lowered to about 100V as shown in FIG. 6A. The address electrode 2 is maintained at a bias voltage, e.g., 100V at which an unnecessary discharge is not produced. Therefore, even if an address signal voltage applied to another cell (pixel) (discharge space) is applied to an address X electrode (anode) 1 of another cell (pixel) (discharge space), the wall charges are maintained as they are.

Since the address electrodes 1, 2 are both exposed to the gas space, a line sequential drive for producing the address discharge is carried out similarly to an ordinary DC type PDP. As shown in FIGS. 6C and D, during the address period, the voltage of 150 higher than the discharge space potential (e.g., about 100V) is applied to the memory electrode 3 and the voltage of 50V lower than the discharge space potential is applied to the memory electrode 4 so that both of the memory electrodes 3, 4 do not influence a start of the address discharge. When the address discharge is produced in this state, the generated charges are charged on the insulating layers 3*a*, 4*a* of the memory electrodes 3, 4 to form the wall charges thereon.

The negative charges and the positive charges are respectively formed on the memory electrodes 3, 4 in response to the above-mentioned distributed potentials of the memory electrodes 3, 4. The address operation is carried out in a line sequential fashion, e.g., from an uppermost line of the screen to a lowermost line thereof.

As shown in FIGS. 6C and D, during the memory period, AC voltages whose polarities are opposite to each other with their highest voltage of 150V and their lowest voltage of 50V (voltages obtained by superposing an AC voltage with an amplitude of 50V on a DC voltage of 100V) are respectively applied to the memory electrodes 3, 4 as sustain pulses. The discharge is produced in a cell where an electric field generated by accumulation of the wall charges generated by the address discharge is superposed on the sustain pulse and the discharge is not produced in a cell where an addressing is not carried out and the wall charge is not accumulated. Thus, the discharge is maintained on the screen during the memory period in response to the image information.

A drive method shown in FIG. 7 will be described. It is necessary in this drive method that the wall charges are uniformly accumulated on the surfaces of the insulating layers 3*a*, 4*a* on the lattice apertures of the memory electrodes 3, 4. Accordingly, when the discharge display apparatus is driven, a reset pulse is applied to the memory electrodes 3, 4 before the address signal is applied and the discharge is produced in all the discharge cells of the memory electrodes 3, 4 on the screen or on the line to form the wall charges on the surfaces of the insulating layers 3*a*, 4*a* in the respective discharge cells. A specific method of forming the wall charges by applying the reset pulse is as follows. If a reset pulse voltage sufficient to start the discharge is applied between the memory electrodes 3, 4 to maintain the voltage during a period when the charged particles generated by the reset discharge exist in the discharge cell or if a voltage higher than the discharge space potential (e.g., 150V) and a voltage lower than the discharge space potential (e.g., 50V) are respectively applied to the memory electrodes 3, 4, then the wall charges in each of the discharge cells are maintained as they are. If a voltage of 100V which is substantially equal to the discharge space potential is applied to the memory electrodes 3, 4 when the charged particles disappear after a predetermined time, then the wall charges in the respective discharge cells are maintained as they are even thereafter.

Figures 7A, 7B, 7C, 7D:
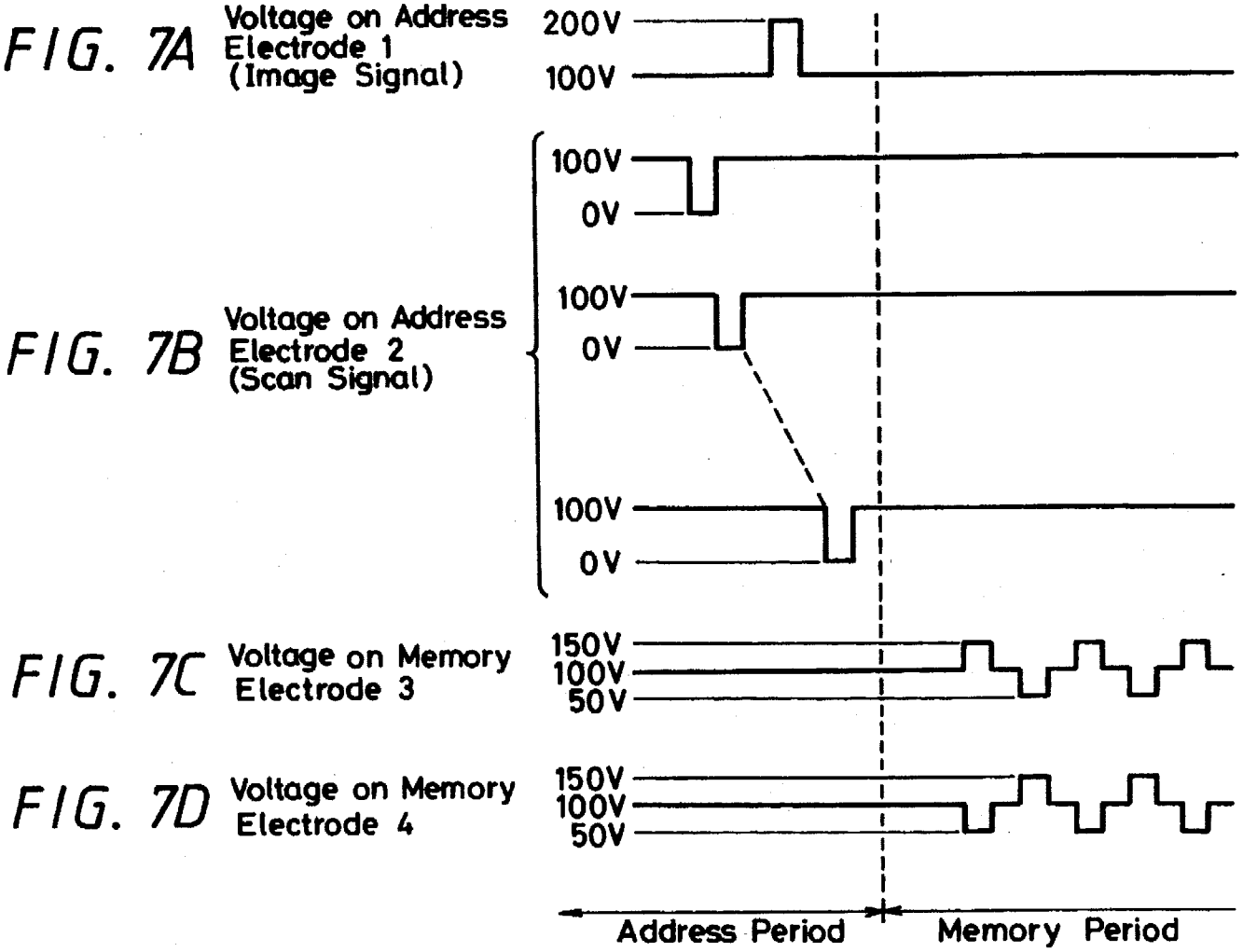
FIG. 7A is a timing chart with respect to a voltage (image signal) on the address electrode 1 used to explain an operation of the discharge display apparatus according to the first embodiment.
FIG. 7B is a timing chart with respect to a voltage (scanning signal) on the address electrode 2 used to explain the operation of the discharge display apparatus according to the first embodiment.
FIG. 7C is a timing chart with respect to a voltage on the memory electrode 3 used to explain the operation of the discharge display apparatus according to the first embodiment.
FIG. 7D is a timing chart with respect to a voltage on the memory electrode 4 used to explain the operation of the discharge display apparatus according to the first embodiment.

As shown in FIGS. 7C and D, both of the memory electrodes 3, 4 are maintained at about 100V and the negative and positive wall charges are respectively accumulated on the insulating layers 3*a*, 4*a* of the memory electrodes 3, 4 in the discharge spaces 10. In this state, as shown in FIG. 7A, a positive voltage of 200V which is sufficient for the address discharge is applied to the address electrode 1 and, as shown in FIG. 7B, a ground potential is applied to the address electrode 2. Charged particles generated by the address discharge are recombined with the wall charges on the insulating layers 3*a*, 4*a* of the memory electrodes 3, 4 to erase the wall charges. Then, as shown in FIG. 7A, the voltage applied to the address electrode 1 is lowered to about 100V but, as shown in FIGS. 7C and D, both of the memory electrodes 3, 4 are maintained at a voltage of about 100V which is the same bias voltage. The surface of the memory electrode 3 is maintained at 50V lower than the above voltage of 100V because of the wall charges thereon and the surface of the memory electrode 4 is maintained at about 150V higher than the above voltage of 100V because of the wall charges thereon. Therefore, the positive and negative charged particles in the space where the discharge is produced are respectively attracted to the memory electrodes 3, 4 and recombined with the wall charges on the insulating layers 3*a*, 4*a* of the memory electrodes 3, 4 in the discharge spaces 10. Then, the address signal is successively applied to a subsequent discharge space. Both of the voltages of the memory electrodes 3, 4 are maintained in the same state during that period so that the wall charge states in the respective discharge spaces are maintained as long as a new discharge is not produced.

In a state that the maintaining pulse for the memory discharge is applied between the memory electrodes 3, 4 after it is finished to address all the discharge cells of one screen, similarly to an operation of an ordinary AC type PDP, the discharge is produced in the cell where an electric field generated by the wall charges is superposed on the maintaining pulse and the discharge is not produced in the cell where the addressing is not carried out and the wall charge is not accumulated. Specifically, the charged particles generated by the address discharge are recombined with the wall charges on the insulating layers 3*a*, 4*a* of the memory electrodes 3, 4 to thereby erase the wall charges. The wall charges in the cell where the address discharge is not produced remains as they are.

The wall charges are formed in the respective cells in response to the image information during the memory period. As shown in FIGS. 7C and D, during the memory period, the AC voltage with a highest voltage of 150V and a lowest voltage of 50V (obtained by superposing an AC voltage of 50 V on the DC voltage of 100V) is applied between the memory electrodes 3, 4 as the discharge maintaining pulse. Depending upon whether or not the wall charges exist in the discharge cell, the discharge is produced in the discharge space where the electric field generated by the wall charges is superposed on the maintaining pulse while the discharge is not produced in the cell where the wall charges are erased. Thus, a lighting or non-lighting state is continued in the discharge space 10 corresponding to the pixel on the screen of the PDP during the memory period in response to the image informations.

Figure 8:
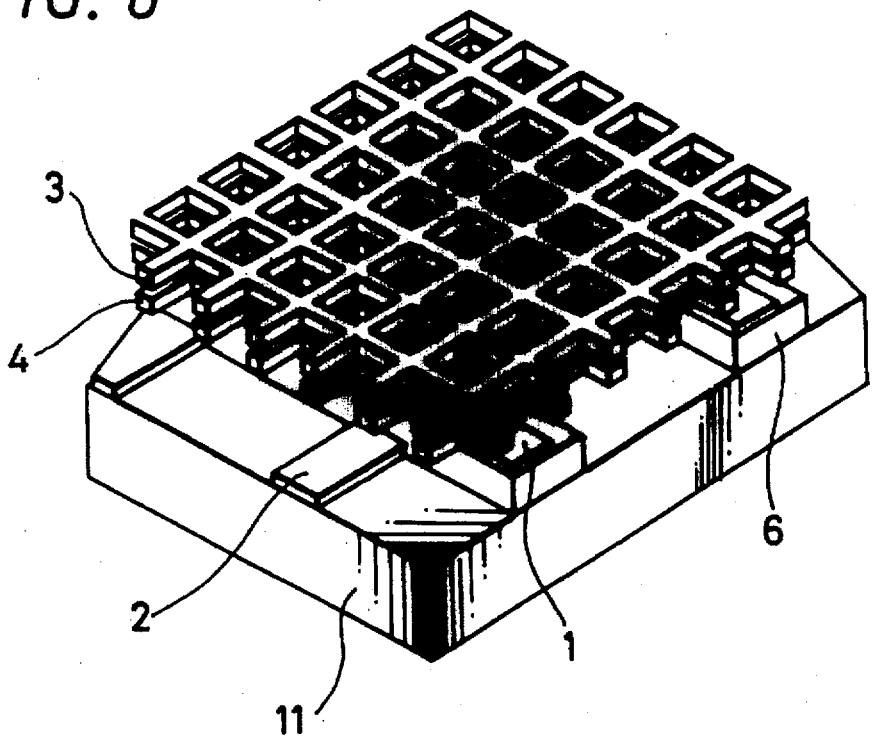
FIG. 8 is a perspective view showing a main part of a discharge display apparatus according to a second embodiment of the present invention.
Figure 9:
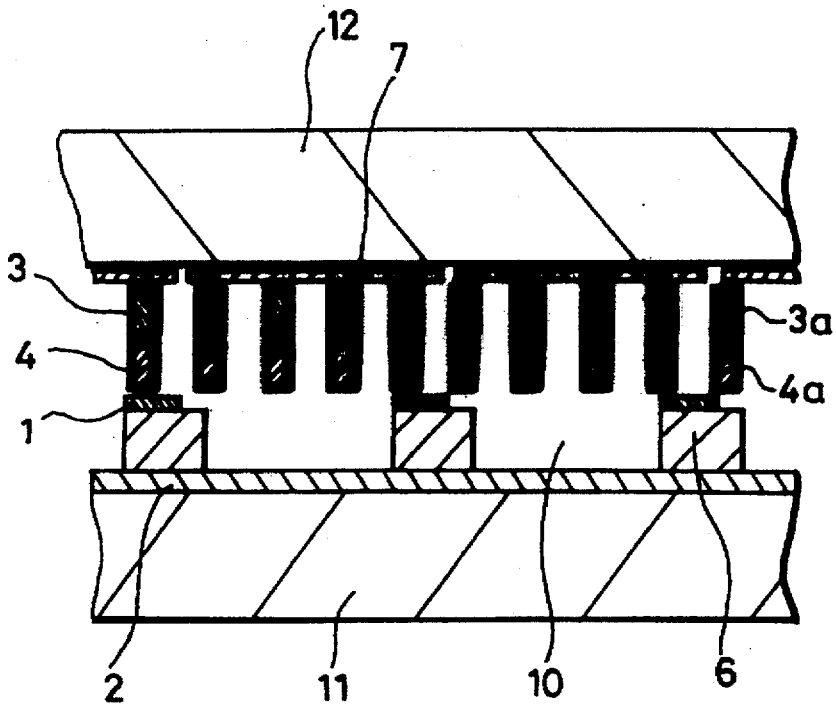
FIG. 9 is a cross-sectional view showing the discharge display apparatus according to the second embodiment.

Second embodiment (shown in FIGS. 8 and 9)

A second embodiment according to the present invention will be described with reference to FIGS. 8 and 9 which respectively show a perspective view and cross-sectional view of a main part of the discharge display apparatus. This second embodiment is a modification of the first embodiment shown in FIGS. 4 and 5 and different from the first embodiment in that diameters of lattice apertures of two memory electrodes 3, 4 are set smaller than lattice apertures formed by a plurality of address electrodes 1, 2 and that a plurality of lattice apertures of the two memory electrodes 3, 4, nine lattice apertures thereof as shown in FIG. 8, correspond to one lattice aperture (which can be shaped into some proper shapes, such as a square, a rectangle, a circle, an ellipse or the like) formed by the plurality of address electrodes 1, 2.

When many lattice apertures of the two memory electrodes 3, 4 correspond to one of the lattice aperture formed by the plurality of address electrodes 1, 2, it is not necessary to position a pair of the two memory electrodes 3, 4 with respect to the address electrodes 1, 2. In this case, in order to avoid a moire in a reproduced image caused by difference between diameters of the lattice apertures formed by the plurality of address electrodes 1, 2 and those of the lattice apertures of the two memory electrodes 3, 4, it is possible to set an angle of about 30° to 45° between an arrangement direction of the lattice apertures formed by the plurality of address electrodes 1, 2 and an arrangement direction of the lattice apertures of the two memory electrodes 3, 4.

Although it is easy to set the diameters of the lattice apertures of a pair of the two memory electrodes 3, 4 to about 50 μm, if such setting is made, then a secondary electron emission efficiency from the cathode in the aperture is increased by a hollow effect so that the discharge maintaining voltage is lowered to thereby lower a consumption voltage.

As shown in FIG. 9, a fluorescent layer 7 is deposited on a portion of a front glass plate 12 opposed to a discharge space 10. It is possible that, instead of the fluorescent layer 7 or with the fluorescent layer 7, an electrode having the same structure as the memory electrodes 3, 4 is laminated between the two memory electrodes 3, 4 such that apertures of these three electrodes are matched with each other and a fluorescent layer is deposited on an inner wall of the aperture of the intermediate electrode (which is coated with an insulating layer). The fluorescent layer 7 is also a single-colored fluorescent material or red, green and blue fluorescent materials repeatedly and successively disposed in the horizontal and/or vertical-direction.

The discharge display apparatus of the second embodiment is operated similarly to the first embodiment.

Figure 10:
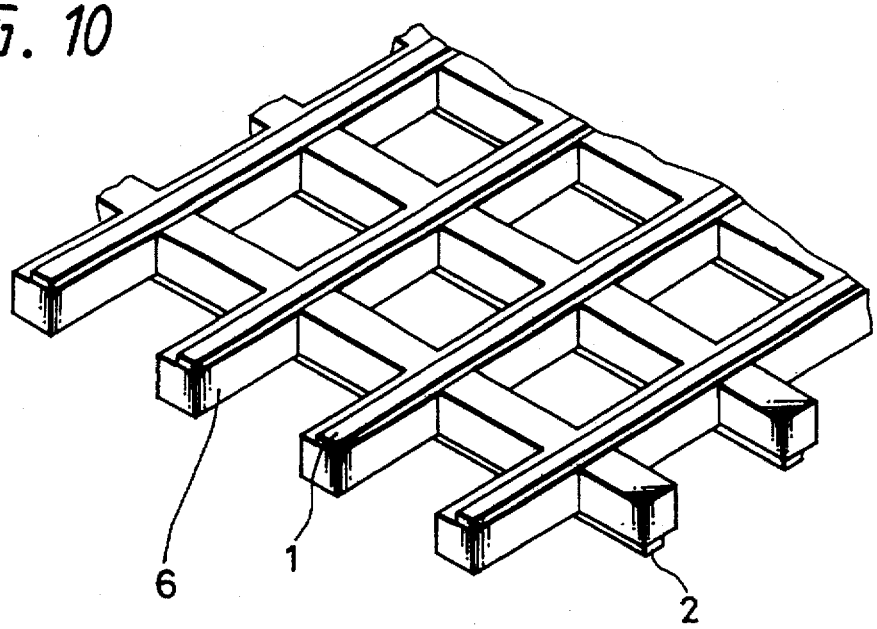
FIG. 10 is a perspective view showing a part of a discharge display apparatus according to a third embodiment of the present invention.

Third embodiment (shown in FIG. 10)

A third embodiment according to the present invention will be described with reference to FIG. 10 which shows a partition and address electrodes of the third embodiment. While the partitions 6 described in the first and second embodiments are formed of a plurality of partitions provided in a striped fashion so as to correspond to the plurality of address electrodes 1, as shown in FIG. 10, the partition 6 in the third embodiment is formed in a lattice fashion and a plurality of address electrodes 1 and a plurality of address electrodes 2 are respectively deposited on upper and lower surfaces of the partition 6 so as to cross each other at substantially right angles. Instead of being entirely made of an insulator, the partition 6 may be formed by using a memory electrode entirely coated with an insulating layer. In this case, in order to increase the withstanding voltage between the plurality of address electrodes 1, 2, the insulating layer is increased in thickness as compared with the insulating layer used as the memory electrode.

In this case, a crosstalk between adjacent pixels can be avoided by setting widths of the plurality of address electrodes 1, 2 narrower than widths of surfaces of the partition 6 Where the address electrodes 1, 2 are formed. If the plurality of address electrodes 1, 2 are displaced in one direction of the width directions of the surfaces of the partition 6 where the address electrodes 1, 2 are formed, then it becomes further difficult to cause the crosstalk between the adjacent pixels.

Fourth embodiment (shown in FIGS. 11 through 14)

Figure 14:
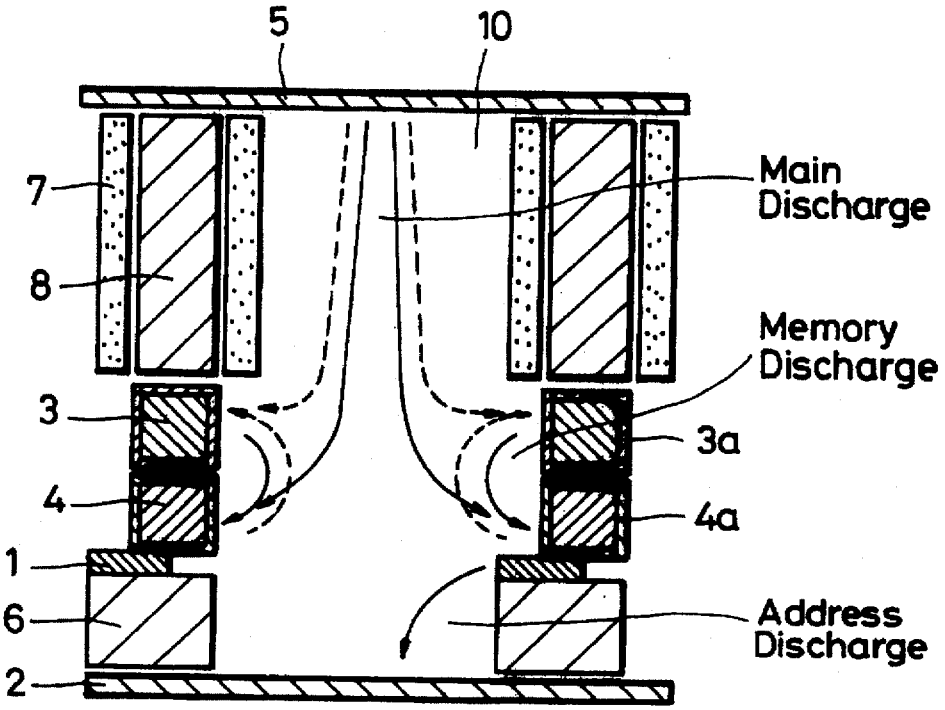
FIG. 14 is a cross-sectional view showing a discharge path according to the fourth embodiment.

A fourth embodiment according to the present invention will be described with reference to FIGS. 11 and 12 which respectively show a perspective view and a cross-sectional view of a main part of the discharge display apparatus and with reference to FIGS. 13 and 14 which respectively show a timing chart thereof and a discharge path thereof.

A structure of the discharge display apparatus of the fourth embodiment will be described with reference to FIGS. 11 and 12. The discharge display apparatus is a PDP arranged such that a body having a structure described later on is housed in a tube body formed by sealing peripheries of a front glass plate 12 and a rear glass plate 11 with a frit glass and that after a vacuum is produced in the tube body, a discharge gaseous substance (gas) (200 torr to 400 torr), such as helium, neon, argon, xenon or the like or a mixed gaseous substance made thereof, is sealed into the tube body.

A plurality of address electrodes (X electrodes) 2 of a stripe shape are disposed in parallel to each other at predetermined intervals and deposited on the rear glass plate 11. The address electrodes 2 can be deposited with ease by a thick-film technology, such as a screen printing method or the like, or a thin-film technology, such as a photo process or the like. A plurality of partitions (made of an insulator) 6 of a stripe shape are disposed in parallel to each other at constant intervals and deposited on the rear glass plate 11 and the address electrodes 2 so as to cross the plurality of address electrodes 2 at substantially right angles. The plurality of partitions 6 each having a predetermined height can be obtained by repeatedly effecting the screen printing. The height of the plurality of partitions 6 is set to an optimum value in response to a gas pressure, a gas composition, a pixel pitch and so on. A plurality of address electrodes (Y electrodes) 1 of a stripe shape are deposited on the plurality of partitions 6. The address electrodes 1 are deposited similarly to the address electrodes 2. Thus, the plurality of address electrodes 1, 2 are disposed so as to cross each other at substantially right angles with a predetermined distance.

A thickness of each of the partitions 6 is set optimum in consideration of a gas pressure, gas composition, a pixel pitch and so on, generally set substantially within the range from 80 μm to 200 μm. The partitions 6 may be formed in a lattice fashion in order to reliably avoid a crosstalk between adjacent pixels.

Any of the plurality of address electrodes 1, 2 may be used as the anodes or the cathodes. Since it is necessary to produce the discharge from any one side of the plurality of partitions 6, the plurality of address electrodes 1 disposed on the upper side of the plurality of partitions 6 may be displaced toward one side of the partition 6 in the width direction.

A pair of lattice-shaped memory electrodes 3, 4 are entirely covered with insulating layers 3*a*, 4*a*, respectively. The two memory electrodes 3, 4 are each made of a conductive layer having a plurality of rectangular apertures disposed in a matrix fashion, i.e., a mesh-shaped conductive plate formed by etching a plate made of metal, such as stainless steel, aluminum, nickel or the like, or alloy thereof. A paste made of, for example, glass powders is formed on the entire surfaces of the memory electrodes 3, 4 by spraying, soaking or the like and fired at high temperature to form the insulating layers 3*a*, 4*a*. Thus, the memory electrodes 3, 4 are entirely covered with the insulating layers 3*a*, 4*a*, respectively. The insulating layers 3*a*, 4*a* may be formed by oxidizing the surfaces of the memory electrodes 3, 4 themselves made of the above metals or alloy thereof.

The two memory electrodes 3, 4 are set in shape and opposing position so that their lattices should correspond to those formed by the address electrodes 1, 2, respectively. The front glass plate 12 is disposed above the upper side memory electrode 3. The two memory electrodes 3, 4 can have apertures shaped into not only a square or a rectangle but also a circle or an ellipse and so on.

A thick lattice-shaped spacer 8 is disposed on the upper memory electrode 3 such that lattice apertures thereof are respectively connected to lattice apertures formed by the plurality of address electrodes 1, 2 and the lattice apertures of the two memory electrodes 3, 4. A fluorescent layer 7 is deposited on wall surfaces of the lattice apertures of the spacer 8. While the spacer 8 can be formed on a lower surface of the front glass plate 12 by some proper processings, such as the screen printing or the like, it is also possible to form the spacer 8 by some proper processings, such as etching an insulating plate, molding a metal plate or the like, or the spacer 8 may be formed by laminating a plurality of plates.

An optimum value of a height of the spacer 8 is selected in response to a drive condition and set substantially within the substantial range from 0.1 mm to 2.0 mm. As the spacer 8 is higher, a voltage to be applied to a display anode 5 described later on becomes higher. When the height of the spacer 8 exceeds about 1.5 mm, a positive column usually appears and radiation of ultraviolet rays becomes stronger to increase luminance.

The display anode 5 formed of a transparent conductive layer made of some proper materials, such as tin oxide, tin indium oxide or the like, is disposed on the lower surface of the front glass plate 12. The display anode 5 may be formed of a mesh-shaped metal plate having apertures instead of a plane plate.

The spacer 8, the address electrodes 1, 2 and the two memory electrodes 3, 4 are positioned between the front and rear glass plates 12, 11 such that the lattice apertures of the spacer 8, the lattice apertures formed by intersection of the plurality of address electrodes 1, 2 and the lattice apertures of the two memory electrodes 3, 4 are connected to each other to form discharge spaces 10. The fluorescent layer 7 is deposited on the inner walls of the lattice apertures of the spacer 8. The fluorescent layer 7 is a single-colored fluorescent material or red, green and blue fluorescent materials which are repeatedly and successively disposed in the horizontal and/or vertical directions.

An operation of the discharge display apparatus according to the fourth embodiment will be described with reference to FIG. 13. Before the address discharge is selectively produced at positions in response to the image signal of intersection points formed by the plurality of address electrodes 1, 2, as shown in FIGS. 13C and D, a voltage sufficient for the discharge is applied between the two memory electrodes 3, 4 to produce the reset discharge and all the discharge cells on the screen are reset to the same state once.

Figures 13A, 13B, 13C, 13D, 13E:
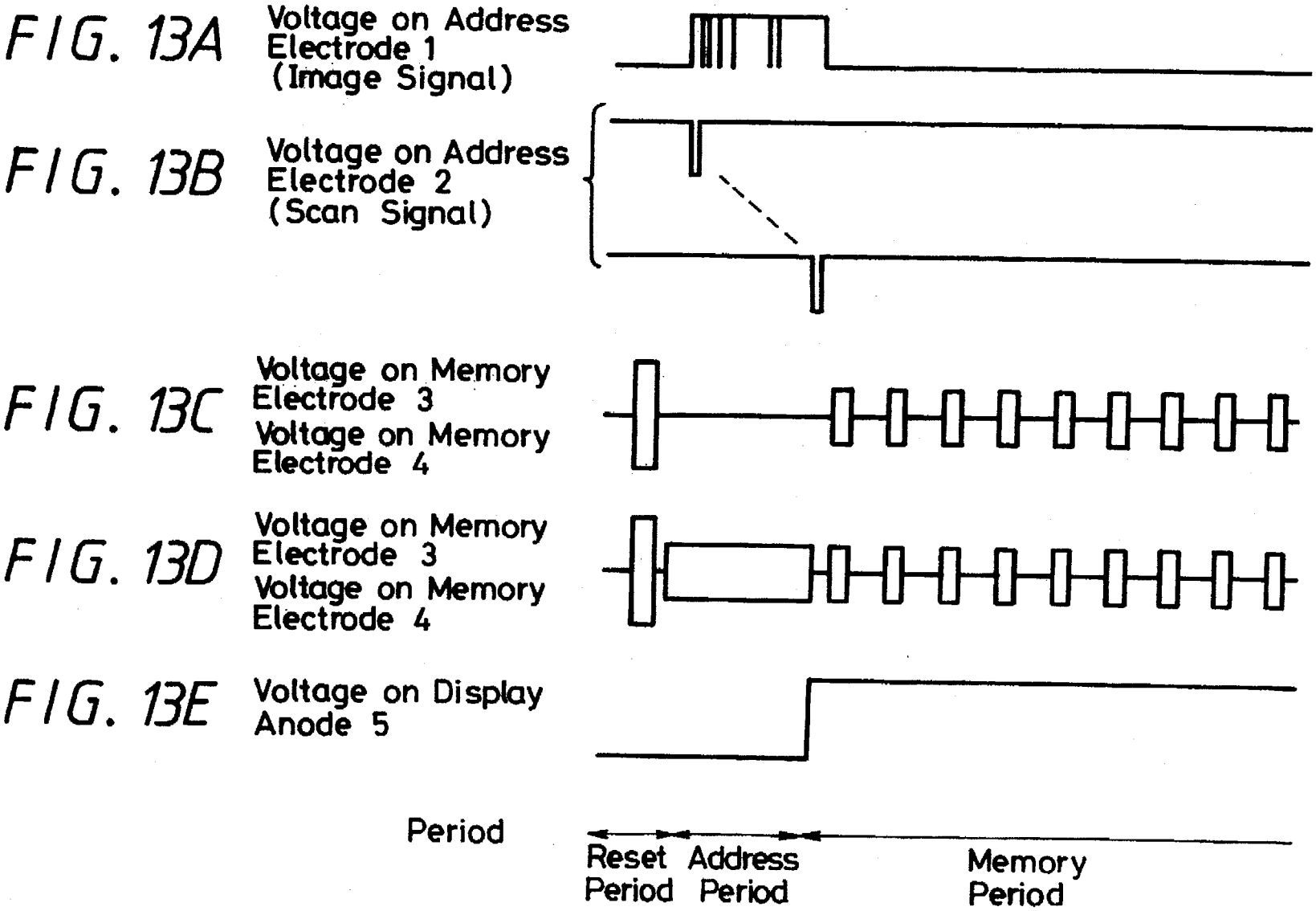
FIG. 13A is a timing chart with respect to a voltage (image signal) on an address electrode 1 according to the fourth embodiment.
FIG. 13B is a timing chart with respect to a voltage (scanning signal) on an address electrode 2 according to the fourth embodiment.
FIG. 13C is a timing chart with respect to voltages on memory electrodes 3, 4 according to the fourth embodiment.
FIG. 13D is a timing chart with respect to voltages on the memory electrodes 3, 4 according to the fourth embodiment.
FIG. 13E is a timing chart with respect to a voltage of a display anode 5 according to the fourth embodiment.

As shown in FIG. 13C, while space charges generated by the reset discharge exist in the discharge cells, both of potentials of the two memory electrodes 3, 4 are maintained at the same potential which is a substantially intermediate potential (hereinafter referred to as intermediate potential) between the potentials applied to the two memory electrodes 3, 4 for the reset discharge. Thus, both of the wall charges on the insulating layers 3*a*, 4*a* of the two memory electrodes 3, 4 are all erased by the space charges generated by the reset discharge, thereby producing a state that there is no wall charge on the entire screen or a state that there remain the wall charges having the same potentials to thereby prevent a potential difference between the memory electrodes 3, 4 from being caused.

If, as shown in FIG. 13D, one of the potentials of the two memory electrodes 3, 4 is maintained at a potential slightly higher than the intermediate potential and the other potential thereof is maintained at a potential slightly lower than the intermediate potential while the space charges generated by the reset discharge still exist in the discharge cells, then the space charges generated by the reset discharge are accumulated as the wall charges on the inner wall surfaces of the lattice apertures of the two memory electrodes 3, 4 in response to polarities of the potentials of the memory electrodes 3, 4, thereby a state that the wall charges are uniformly formed on the entire screen being produced. An initial state for the selective address discharge in response to the image is produced as described above. Then, it is finished to reset all the discharge cells on the entire screen.

In order to selectively produce the address discharge at the intersection points of the plurality of address electrodes 1, 2 in response to the image signal, a voltage in response to the image signal shown in FIG. 13A is applied to one of the address electrodes 1, 2 and a scanning voltage is successively applied to the other thereof, whereby a voltage sufficient for the address discharge is applied between the address electrodes 1, 2. When the address discharge is produced, the discharge space 10 fills with ions, electrons or metastable atoms and the potential of the discharge space 10 in the plasma state becomes a potential for a voltage at which the discharge to cathodes (which are either of the address electrodes 1, 2 in this embodiment) are substantially maintained.

Under such condition, depending upon whether the two memory electrodes 3, 4 are maintained at a potential higher or lower than the discharge space potential, the polarities and amounts of the charges accumulated on the surfaces of the insulating layers 3*a*, 4*a* of the two memory electrodes 3, 4 are changed. Specifically, when the potentials of the two memory electrodes 3, 4 are maintained at the higher potential during the address discharge, negative space charges, i.e., electrons are attracted to the surfaces of the insulating layers 3*a*, 4*a* of the two memory electrodes 3, 4 and accumulated thereon as the wall charges, while when the potentials thereof are maintained at the lower potential during the address discharge, positive charges, i.e., ions are attracted thereto and accumulated thereon as the wall charges. An amount of the accumulated charges are determined by difference between the potential of the two memory electrodes 3, 4 and the plasma potential, dielectric constants of the insulating layers 3*a*, 4*a*, thicknesses thereof and so on.

There is supposed an initial state that there is no wall charge on the insulating layers 3*a*, 4*a* of the two memory electrodes 3, 4 due to the above-mentioned reset discharge. In order to memorize the wall charges generated by the address discharge in the two memory electrodes 3, 4 as informations based on the image signal in such state, it is sufficient to maintain the memory electrode 3 of the two memory electrodes 3, 4 at the high potential and the memory electrode 4 of the two memory electrodes 3, 4 at the low potential during the address discharge. Specifically, the wall charges are formed on the wall surfaces of pixels, i.e., lattice apertures where the address discharge is produced and the wall charges are not formed on the wall surfaces of the lattice apertures where the address discharge is not produced. Thus, after the address period is finished, the image can be displayed by applying a pulse shown in FIG. 13C or 13D to the two memory electrodes 3, 4 and the memory display is carried out until the next address discharge.

The above description about the operation is made without consideration of the display anode 5 and the operation is similar to the operation of the example 1 shown in FIG. 1. The operation will be described in consideration of the display anode 5. As shown in FIG. 13E, during the reset period and the address period, a voltage applied to the display anode 5 is set at a low voltage which does not influence the address electrodes 1, 2 and the memory electrodes 3, 4. Subsequently, in a state that the address discharge period is finished and the wall charges are selectively formed in the discharge cells, the operation proceeds to the memory operations. At this time, as shown in FIG. 13E, the voltage applied to the display anode 5 is set at a higher voltage. The voltage applied to the display anode 5 is set at a higher voltage at which a discharge that does not concern the display is not produced. In this state, the selective memory discharge is started in accordance with distribution of the wall charges formed during the address discharge period.

The voltage applied to the display anode 5 (shown in FIG. 13E) is different between the above-mentioned reset and address periods and the memory period. The difference between the voltages applied during the reset and address periods and the memory period is changed depending upon a structure of the discharge cell (discharge space), a gas pressure and so on. However, the difference voltage is relatively small. Depending upon states or conditions, it is possible to apply a constant DC voltage (bias voltage) to the display anode 5 during all the reset, address and memory periods.

An operation of the display anode 5 will be described with reference to FIG. 14. A discharge space 10 shown in FIG. 14 shows a discharge space corresponding to one pixel on the screen. In this case, since the discharge space 10 fills with the ionized charged particles and metastable atoms, even if the voltage applied to the display anode 5 is low, then the discharge is produced between the display anode 5 and the low voltage side memory electrode of the two memory electrodes 3, 4. In other words, a discharge current from the display anode 5 is added to a memory discharge current. Even if new wall charges are formed and a half period of the memory discharge is stopped, then the current from the display anode 5 is similarly supplied to the memory discharge continuously produced during the next half period. Specifically, while the memory discharge is continuously produced, the current from the display anode 5 is continuously supplied to the two memory electrodes 3, 4 side. Moreover, in other words, the discharge between the two memory electrodes 3, 4 is drawn by the display anode 5 to a space between the display anode 5 and the two memory electrodes 3, 4. As shown in FIG. 14, this discharge positionally drawn thereto is produced along the inner walls of the spacer 8 on which the fluorescent layers 7 are deposited in the lattice aperture. Accordingly, ultraviolet rays produced by the discharge excite the fluorescent layers 7 to emit light. Since the charged particle does not exist in the discharge space of the pixel where the memory discharge is not produced, the discharge is not produced by the voltage of about 200V to 300V, for example, applied to the display anode 5.

Figure 15:
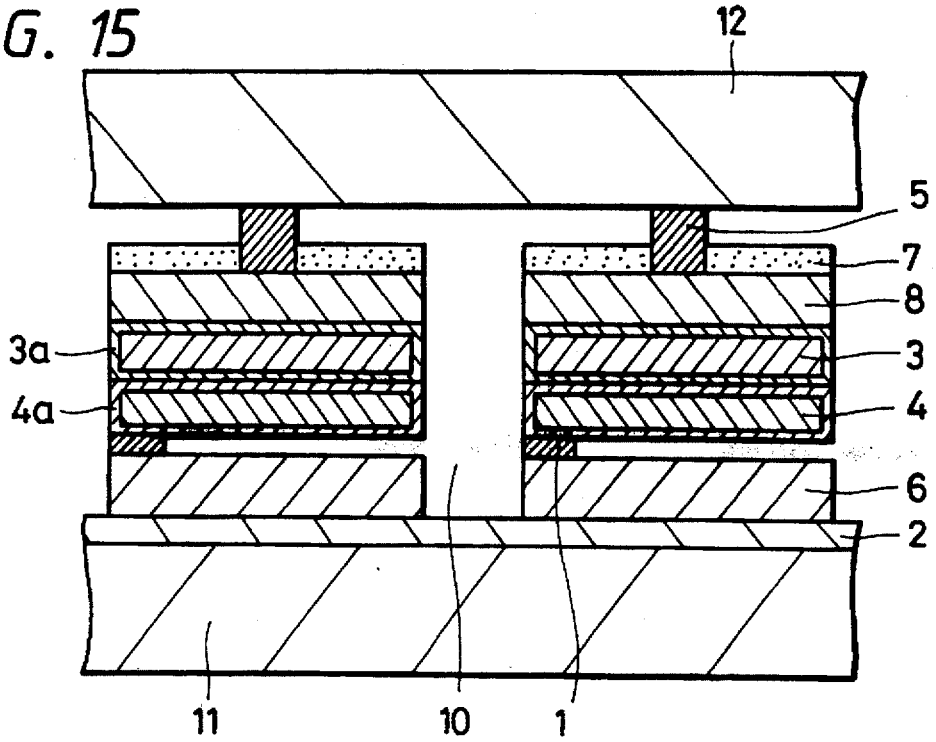
FIG. 15 is a cross-sectional view showing a main part of a discharge display apparatus according to a fifth embodiment of the present invention.
Figure 16:
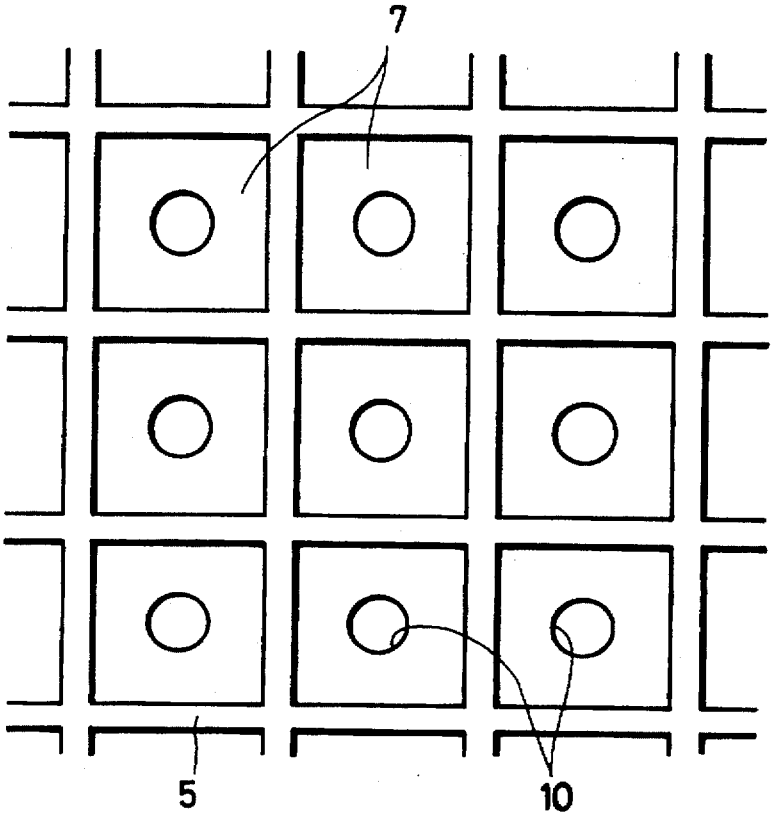
FIG. 16 is a plan view showing the discharge display apparatus according to the fifth embodiment.

Fifth embodiment (shown in FIGS. 15 and 16)

A fifth embodiment according to the present invention will be described with reference to FIGS. 15 and 16 which respectively show a cross-sectional view of the discharge display apparatus and a plan view thereof with its front glass plate being removed. Like elements and parts corresponding to those shown in FIGS. 11 and 12 are marked with the same reference numerals and therefore need not be described in detail.

In the discharge display apparatus of the fifth embodiment, a spacer 8 is set thinner as compared with the spacer 8 of the fourth embodiment. A lattice-shaped display anode 5 is deposited on an upper surface of the spacer 8 opposed to a front glass plate 12. A fluorescent layer 7 is deposited on the upper surface of the spacer 8 excluding portions thereof where the display anodes 5 are deposited. A discharge space 10 is positioned in a lattice aperture of the lattice-shaped display anode 5. Other structures and operations are similar to the discharge display apparatus of the fourth embodiment and need not be described in detail.

Sixth embodiment (shown in FIGS. 17 through 20)

A sixth embodiment according to the present invention will be described with reference to FIGS. 17 and 18 which respectively show a perspective view and a cross-sectional view of a main part of the discharge display apparatus and with reference to FIGS. 19 and 20 which respectively show a timing chart thereof and a discharge path thereof.

A structure of the discharge display apparatus of the sixth embodiment will be described with reference to FIGS. 17 and 18. The discharge display apparatus is a PDP arranged such that a body having a structure described later on is housed in a tube body formed by sealing peripheries of a front glass plate 12 and a rear glass plate 11 with a frit glass and that after a vacuum is produced in the tube body, a discharge gaseous substance (gas) (200 torr to 400 torr), such as helium, neon, argon, xenon or the like or a mixed gaseous substance made thereof, is sealed into the tube body.

Plural pairs of memory electrodes (X1 electrodes) 2 and memory electrodes (X2 electrodes) 2' which also serves as address electrodes each of which are formed to be a striped shape and disposed in parallel to each other at predetermined intervals are deposited on the rear glass plate 11 in parallel to each other at predetermined intervals. The memory electrodes 2, 2' can be deposited with ease by a thick-film technology, such as a screen printing method or the like, or a thin-film technology, such as a photo process or the like. An insulating layer 9 is entirely deposited on the rear glass plate 11 and the memory electrodes 2, 2'. A protective layer (not shown) made of materials, such as magnesium oxide (MgO) or the like, is deposited on the insulating layer 9. A plurality of partitions 6 (made of an insulator) 6 of a stripe shape are deposited on the protective layer in parallel to each other at constant intervals so as to cross the plurality of address electrodes 2, 2' at substantially right angles. The plurality of partitions 6 each having a predetermined height can be obtained by repeatedly effecting the screen printing. The height of the plurality of partitions 6 is set to an optimum value in response to a gas pressure, a gas composition, a pixel pitch and so on. A plurality of address electrodes (Y electrodes) 1 of a stripe shape are deposited on the plurality of partitions 6. The address electrodes 1 are deposited similarly to the address electrodes 2'. Thus, the plurality of address electrodes 1, 2' are disposed so as to cross each other at substantially right angles with a predetermined interval.

A thickness of each of the partitions 6 is set optimum in consideration of a gas pressure, gas composition, a pixel pitch and so on, generally set substantially within the range from about 80 μm to 200 μm. The partitions 6 may be formed in a lattice fashion in order to reliably avoid a crosstalk between adjacent pixels.

Any of the plurality of address electrodes 1, 2' may be used as the anodes or the cathodes. Since it is necessary to produce the discharge from any one side of the plurality of partitions 6, the plurality of address electrodes 1 disposed on the upper side of the plurality of partitions 6 may be displaced toward one side of the partition 6 in the width direction.

A thick lattice-shaped spacer 8 is disposed on the plurality of partitions 6 and the plurality of address electrodes 1 such that lattice apertures of the spacer 8 are respectively connected to lattice apertures formed by the plurality of address electrodes 1, 2'. A fluorescent layer 7 is deposited on wall surfaces of the lattice apertures of the spacer 8. While the spacer 8 can be formed on a lower surface of the front glass plate 12 by some proper processings, such as the screen printing or the like, it is also possible to form the spacer 8 by some proper processings, such as etching an insulating plate, molding a metal plate or the like, or the spacer 8 may be formed by laminating a plurality of plates.

An optimum value of a height of the spacer 8 is selected in response to a drive condition and set substantially within the substantial range from 0.1 mm to 2.0 mm. As the height of the spacer 8 is higher, a voltage to be applied to a display anode 5 described later on becomes higher. When the height of the spacer 8 exceeds about 1.5 mm, a positive column usually appears and radiation of ultraviolet rays becomes stronger to increase luminance.

The display anode 5 formed of a transparent conductive layer made of some proper materials, such as tin oxide, tin indium oxide or the like, is disposed on the lower surface of the front glass plate 12. The display anode 5 may be formed of a mesh-shaped metal plate having apertures instead of a plane plate.

The spacer 8 and the address electrodes 1, 2' are positioned between the front and rear glass plates 11, 12 such that the lattice apertures of the spacer 8 and the lattice apertures formed by intersection of the plurality of address electrodes 1, 2' are respectively connected to each other to form discharge cells 10. The fluorescent layer 7 is deposited on the inner walls of the lattice apertures of the spacer 8. The fluorescent layer 7 is a single-colored fluorescent material or red, green and blue fluorescent materials which are repeatedly and successively disposed in the horizontal and/or vertical directions.

An operation of the discharge display apparatus according to the sixth embodiment will be described with reference to FIG. 19. Before the address discharge is selectively produced at positions in response to the image signal of intersection points formed by the plurality of address electrodes 1, 2', as shown in FIGS. 19B and C, a reset pulse is applied between the plural pairs of the memory electrodes (X1, X2 electrodes) 2, 2' to produce the discharge in all the pixels once. Thus, the wall charges which remain on the memory electrodes 2, 2' are erased by space charges generated at that time.

Figures 19A, 19B, 19C, 19D:
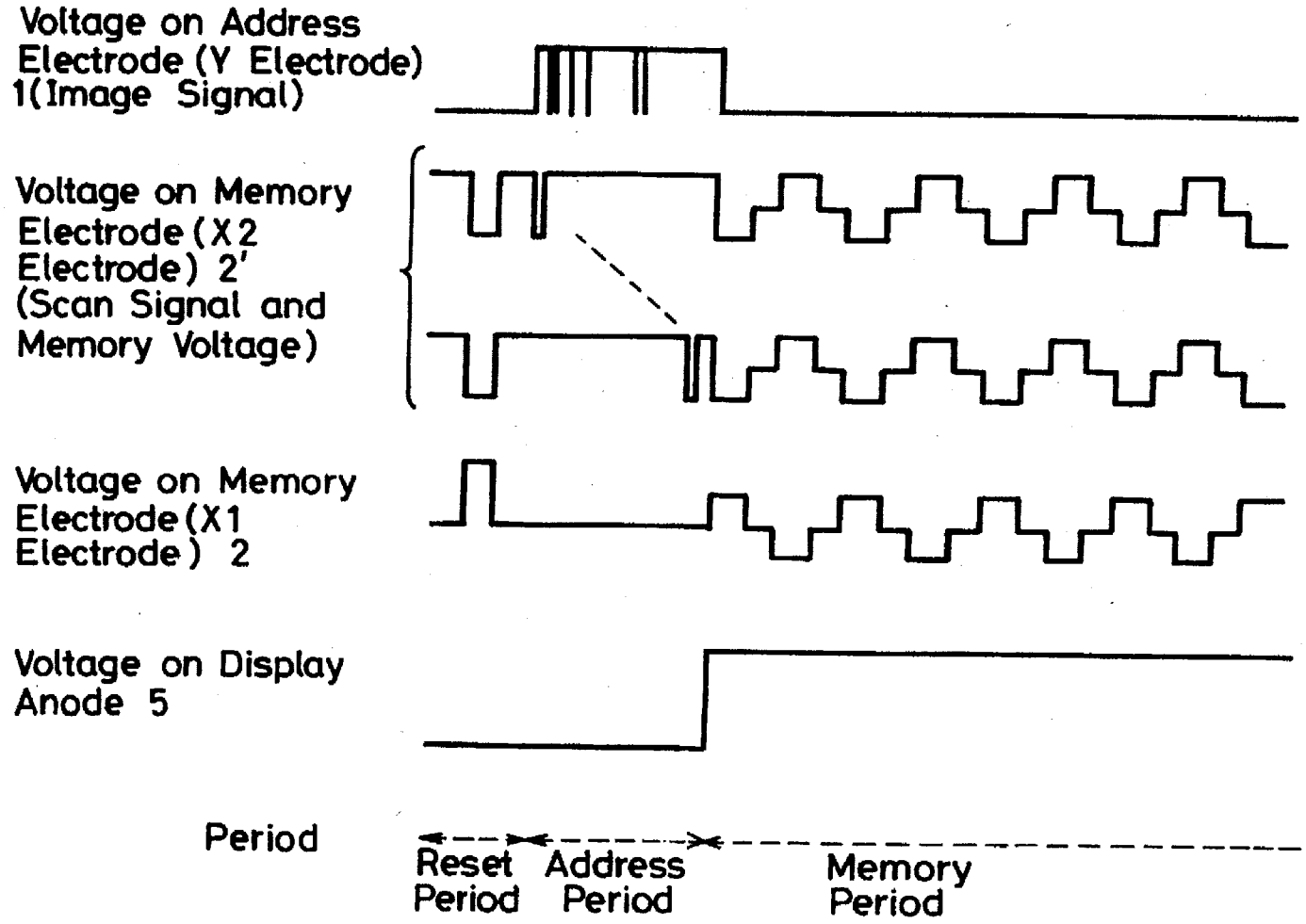
FIG. 19A is a timing chart with respect to a voltage (image signal) on an address electrode (Y electrode) 1 according to the sixth embodiment; discharge display apparatus according to the sixth embodiment.
FIG. 19B is a timing chart with respect to a voltage (scanning and memory voltage) on a memory electrode (X2 electrode) 2' according to the sixth embodiment.
FIG. 19C is a timing chart with respect to a voltage on a memory electrode (X1 electrode) 2 (memory voltage) according to the sixth embodiment.
FIG. 19D is a timing chart with respect to a voltage on a display anode 5 according to the sixth embodiment.
Figure 20:
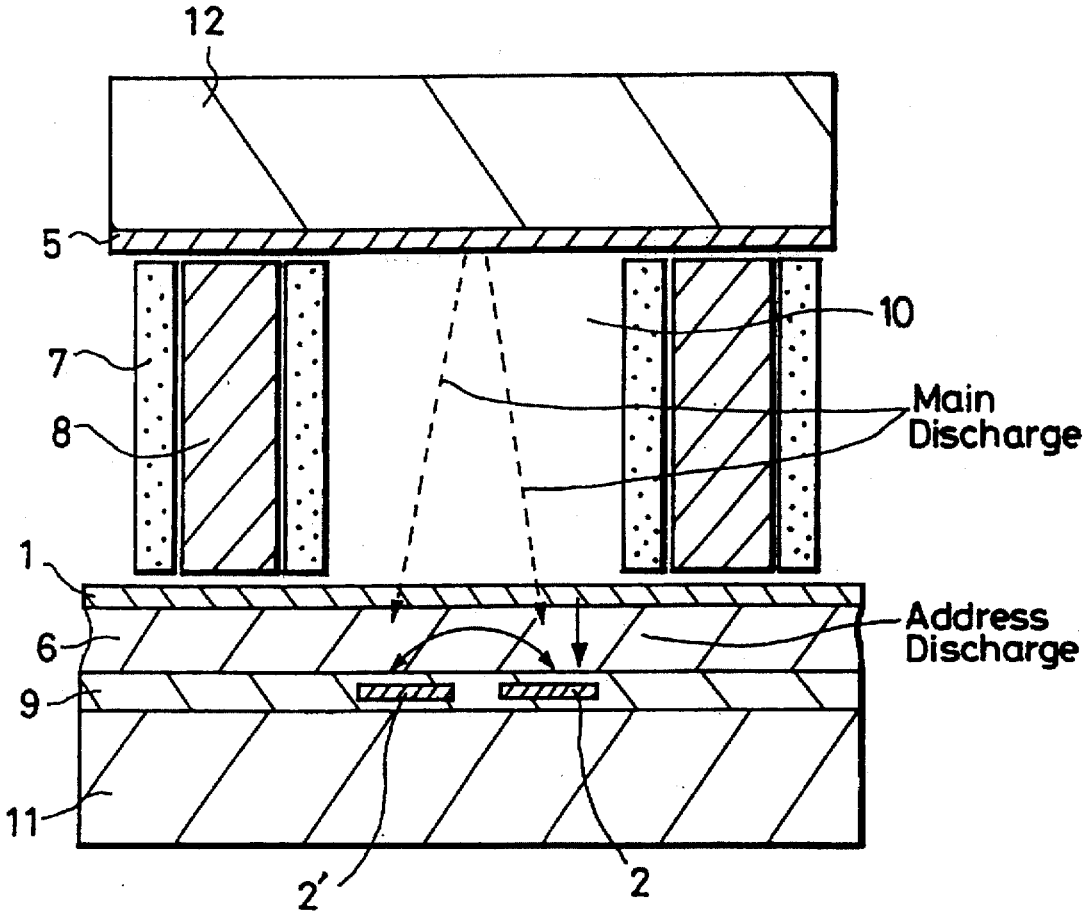
FIG. 20 is a cross-sectional view showing a discharge path according to the sixth embodiment.

When the address period is started next, pulses having a sufficient potential difference are applied between the address electrodes 1, 2', which correspond to a selected pixel, of the plurality of address electrodes 1, 2' as shown in FIGS. 19A and B to produce the address discharge therebetween. Wall charges are accumulated on the insulating layer 9 located on the address electrode 2' because of the address discharge. Immediately thereafter, the address discharge is stopped. A voltage difference caused by the wall charges is produced between selected cells and cells which are not selected. Therefore, if an AC pulse, i.e., a sustain pulse for maintaining the discharge is applied between the memory electrodes 2, 2' during the memory period succeeding the address period as shown in FIGS. 19B and C, then the memory discharge can continuously be maintained in the selected cells.

The above-mentioned operation of the sixth embodiment is similar to that of a three-electrode plane discharge PDP of the example 2 and different therefrom in operation of the display anode 5. As shown in FIG. 19D, during the reset period and the address period, a voltage applied to the display anode 5 is set at a low voltage which does not influence the address electrodes 1, 2' and the plural pairs of the memory electrodes 2, 2'. Subsequently, in a state that the address discharge period is finished and the wall charges are selectively formed in the discharge cells, the operation proceeds to the memory operation. At this time, as shown in FIG. 19D, the voltage applied to the display anode 5 is set at a higher voltage and constantly maintained thereat during the memory period. The voltage applied to the display anode 5 is set at a higher voltage at which a discharge that does not concern the display is not produced between the display anode 5 and the plural pairs of the memory electrodes 2, 2'. In this state, the selective memory discharge is started in accordance with distribution of the wall charges formed during the address discharge period.

The voltage applied to the display anode 5 (shown in FIG. 19D) is different between the above-mentioned reset and address periods and the memory period. The difference voltage is changed depending upon a structure of the discharge cell (discharge space), a gas pressure and so on. However, the difference voltage is relatively small. Depending upon states or conditions, it is possible to apply a constant DC voltage (bias voltage) to the display anode 5 during all the reset, address and memory periods.

An operation of the display anode 5 will be described with reference to FIG. 20. A discharge space 10 shown in FIG. 20 shows a discharge space corresponding to one pixel on the screen. In this case, since the discharge space 10 fills with the ionized charged particles and metastable atoms, even if the voltage applied to the display anode 5 is low, then the discharge is produced between the display anode 5 and the low voltage side memory electrode of the two memory electrodes 2, 2'. In other words, a discharge current from the display anode 5 is added to a memory discharge current. Even if new wall charges are formed and a half period of the memory discharge is stopped, then the current from the display anode 5 is similarly supplied to the memory discharge continuously produced during the next half period. Specifically, while the memory discharge is continuously produced, the current from the display anode 5 is continuously supplied to the two memory electrodes 2, 2' side. Moreover, in other words, the discharge between the two memory electrodes 2, 2' is drawn by the display anode 5 to a space between the display anode 5 and the two memory electrodes 2, 2'. As shown in FIG. 20, this discharge drawn positionally thereto is produced along the inner walls of the spacer 8 on which the fluorescent layers 7 are deposited in the lattice aperture. Accordingly, ultraviolet rays produced by the discharge excite the fluorescent layers 7 to emit light. Since the charged particle does not exist in the discharge space of the pixel where the memory discharge is not produced, the discharge is not produced by the voltage of about 200V to 300V, for example, applied to the display anode 5.

Figure 4:
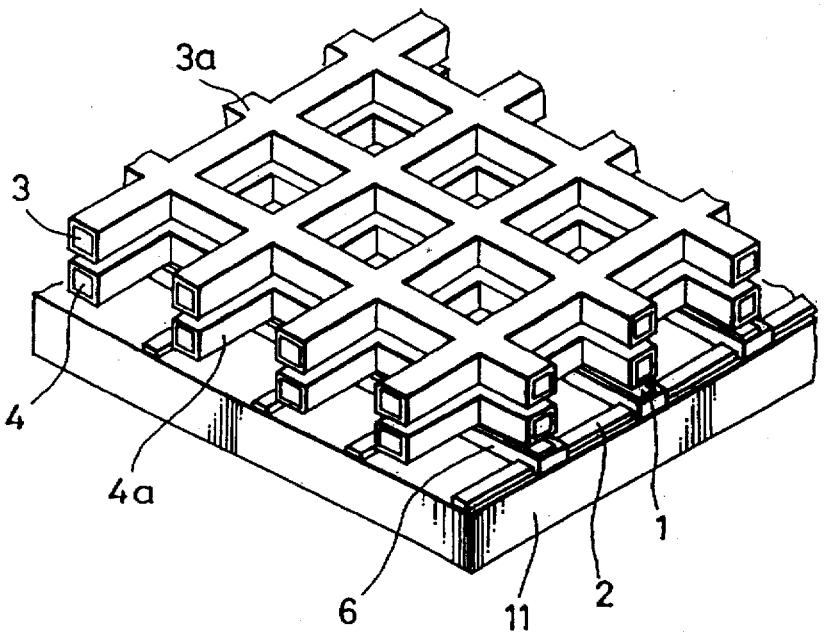
FIG. 4 is a perspective view showing a discharge display apparatus according to a first embodiment of the present invention.
Figure 5:
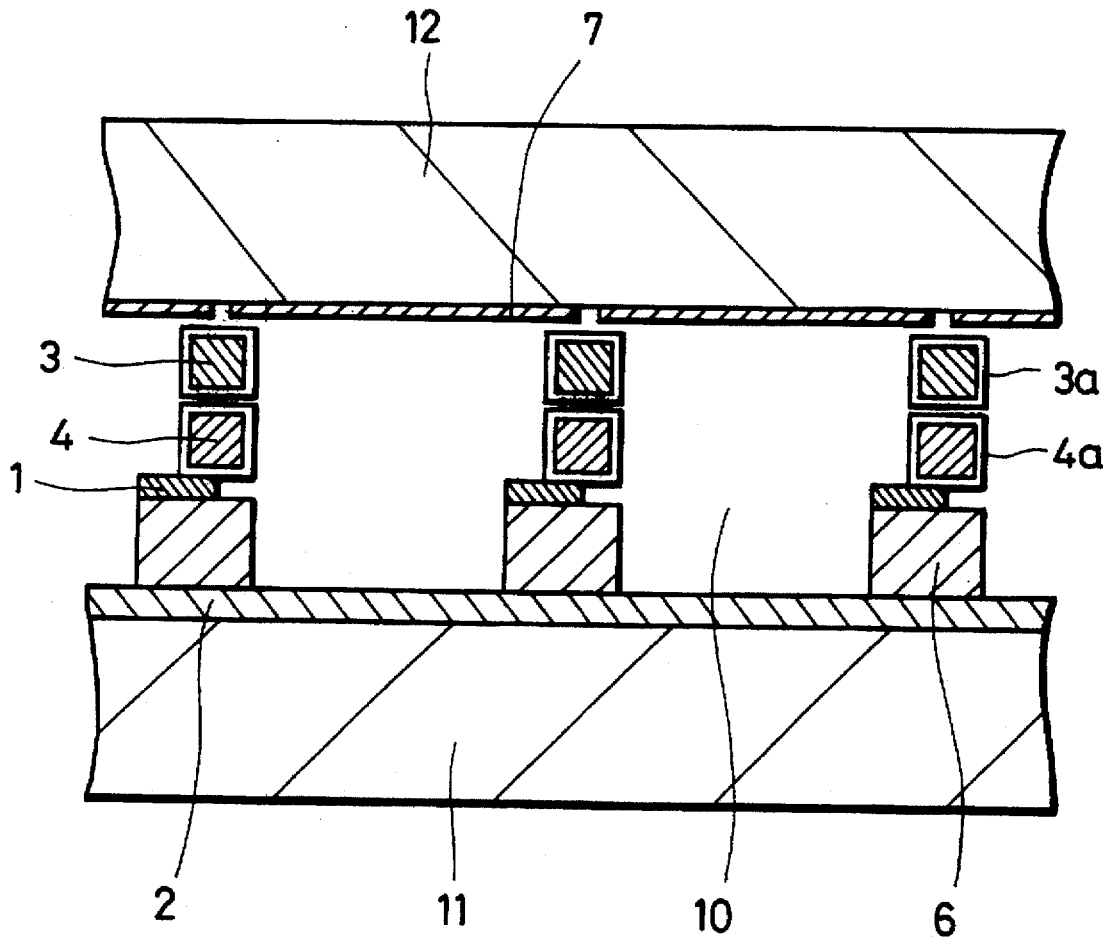
FIG. 5 is a cross-sectional view showing the discharge display apparatus according to the first embodiment.
Figure 11:
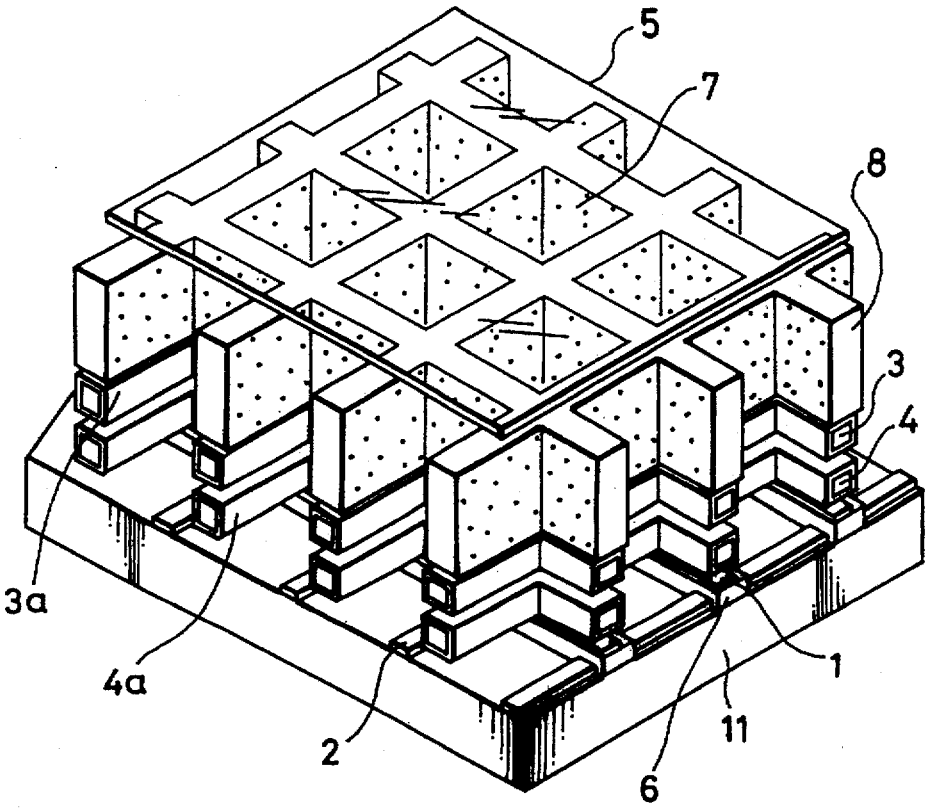
FIG. 11 is a perspective view showing a main part of a discharge display apparatus according to a fourth embodiment of the present invention.
Figure 12:
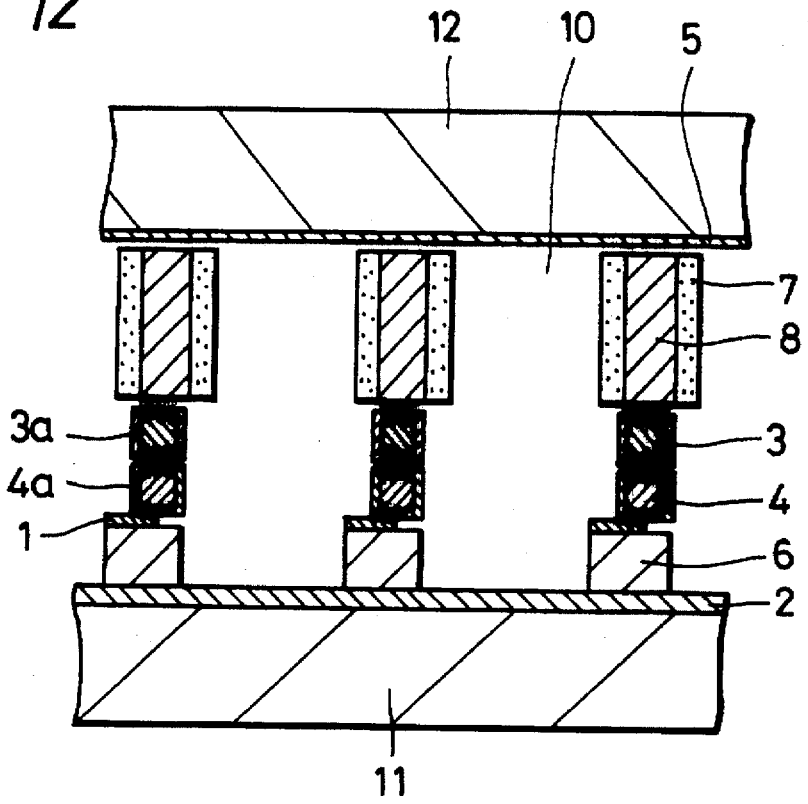
FIG. 12 is a cross-sectional view showing the discharge display apparatus according to the fourth embodiment.

Each of the arrangements of the second embodiment shown in FIGS. 8 and 9 and/or the third embodiment shown in FIG. 10 can be applied to the first embodiment shown in FIGS. 4 and 5, the fourth embodiment shown in FIGS. 11 and 12 and the fifth embodiment shown in FIGS. 15 and 16.

According to the discharge display apparatus of the first aspect of the present invention (described in the first embodiment), as shown in FIGS. 4 and 5, the discharge display apparatus comprises the plurality of first address electrodes 1 and the plurality of second address electrodes 2 both of which are disposed adjacent to each other so as to cross each other through the partition 6 and the memory electrodes 3, 4 (the two memory electrodes 3, 4 disposed adjacent to each other) which have the plurality of apertures provided therethrough and are entirely covered with the respective insulating layers 3*a*, 4*a*. The plurality of first and second address electrodes 1, 2 and the memory electrodes 3, 4 are successively laminated and sealed into the tube body having the discharge gas. Therefore, it is possible to obtain the discharge display apparatus in which high luminance and high efficiency can be realized with simple arrangement, in which the address discharge and the memory discharge are not interfered by a relation between the voltages applied to the address electrode 1, 2 and the memory electrode 3, 4 so that the optimum voltage can be selected, and in which the interval between the first and second address electrodes 1, 2 can be set to the optimum value regardless of the thicknesses of the memory electrodes 3, 4.

According to the discharge display apparatus according of the second aspect of the present invention (described in the fourth embodiment), as shown in FIGS. 11 and 12, the discharge display apparatus comprises the plurality of first address electrodes 1 and the plurality of second address electrodes 2 both of which are disposed adjacent to each other so as to cross each other through the partition 6, the memory electrodes 3, 4 (the two memory electrodes 3, 4 disposed adjacent to each other) which have the plurality of apertures provided therethrough and are entirely covered with the respective insulating layers 3*a*, 4*a*, the spacer 8 which has the plurality of apertures respectively corresponding to the plurality of apertures of the memory electrodes 3, 4 and in which the fluorescent layer 7 is deposited on the inner walls of the plurality of the apertures, and the common electrode (display anode) 5. The plurality of first and second address electrodes 1, 2, the memory electrodes 3, 4, the spacer 8 and the common electrode (display anode) 5 are successively laminated and sealed into the tube body having the discharge gas. Therefore, the memory discharge and the main discharge, i.e., the discharge which contributes to the display carried out by the light emission can be separated with a simple arrangement and a simple drive circuit. Thus, the reset discharge is prevented from influencing the display carried out by the light emission and the contrast is improved drastically. The efficiency of the light emission and the luminance can be drastically improved without any influence on the screen operation carried out by both of the address discharge and the memory discharge.

According to the discharge display apparatus of the third aspect of the present invention (described in the fifth embodiment), as shown in FIGS. 15 and 16, the discharge display apparatus comprises the plurality of first address electrodes 1 and the plurality of second address electrodes 2 both of which are disposed adjacent to each other so as to cross each other through the partition 6, the memory electrodes 3, 4 (the two memory electrodes 3, 4 disposed adjacent to each other) which have the plurality of apertures provided therethrough and are entirely covered with the respective insulating layers 3*a*, 4*a*, the spacer 8 which has the plurality of apertures respectively corresponding to the plurality of apertures of the memory electrodes 3, 4 and in which the fluorescent layer 7 is deposited on the surface on the opposite side of the memory electrodes 3, 4, and the common electrode (display anode) 5. The plurality of first and second address electrodes 1, 2, the memory electrodes 3, 4, the spacer 8 and the common electrode (display anode) 5 are successively laminated and sealed into the tube body having the discharge gas. Therefore, the same effects as those of the discharge display apparatus according to the second aspect of the present invention can be achieved.

According to the discharge apparatus of the fourth aspect of the present invention (described in the second embodiment), as shown in FIGS. 8 and 9, in the discharge display apparatus of the first, second or third aspect of the present invention, the plurality of apertures of the memory electrodes 3, 4 are opposed to one of the lattice apertures formed by the plurality of first address electrodes 1 and the plurality of second electrodes 2. Therefore, in addition to effects achieved by the discharge display apparatus of the first, second and third embodiments, it becomes easy to position the first and second address electrodes 1, 2 and the memory electrodes 3, 4 and it is possible to drastically improve the discharge characteristics by the hollow effect. The more apertures opposed to the lattice apertures formed by the plurality of first address electrodes 1 and the plurality of address electrodes 2 the memory electrodes 3, 4 have, the more remarkable the above effects become.

According to the discharge apparatus of the fifth aspect of the present invention (described in the third embodiment), as shown in FIG. 10, in the discharge display apparatus of the first, second, third or fourth aspect of the present invention, the memory electrode is used as the partition 6 and the plurality of first address electrodes 1 and the plurality of second address electrodes 2 are deposited on both surfaces of the insulating layer of the memory electrode. Therefore, in addition to the effects achieved by the discharge display apparatus of the first, second, third or fourth aspect of the present invention, it becomes easy to position the first and second address electrodes 1, 2 and the memory electrode.

Figure 17:
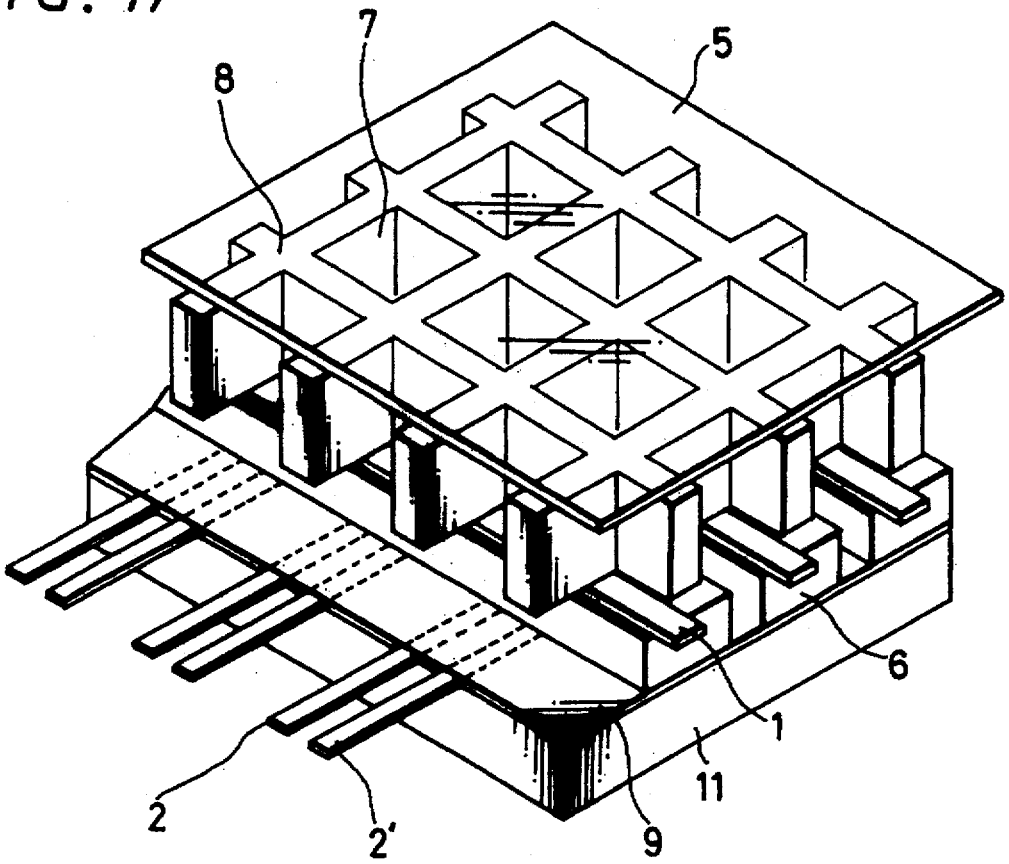
FIG. 17 is a perspective view showing a main part of a discharge display apparatus according to a sixth embodiment of the present invention.
Figure 18:
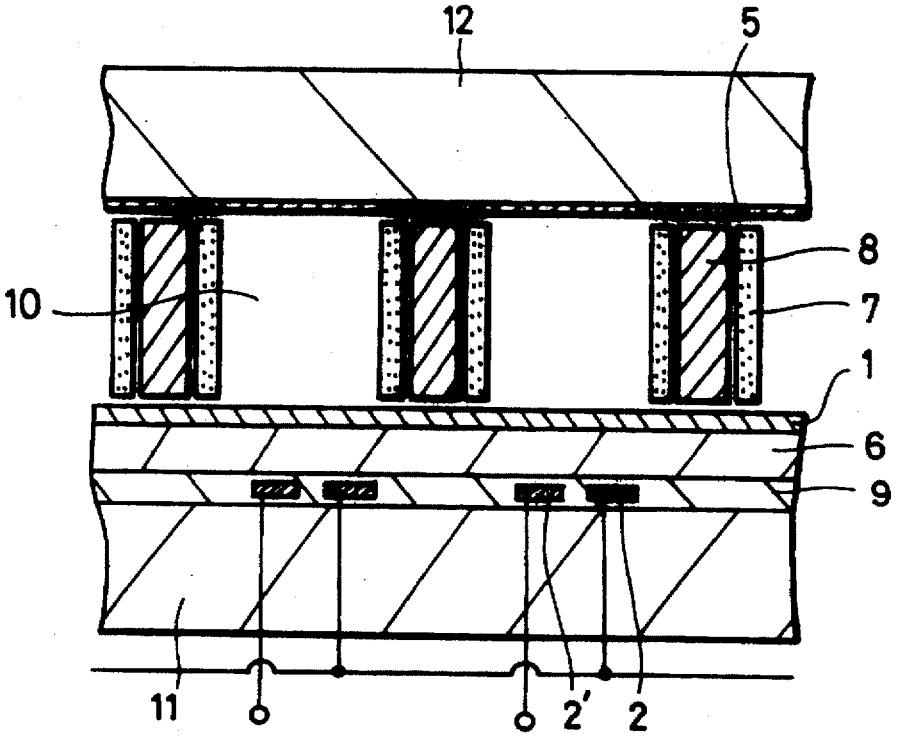
FIG. 18 is a cross-sectional view showing the discharge display apparatus according to the sixth embodiment.

According to the discharge apparatus of the sixth aspect of the present invention (described in the sixth embodiment), as shown in FIGS. 17 and 18, the discharge display apparatus comprises the plural pairs of the first memory electrodes 2 and the second address electrodes 2' serving also as the second memory electrodes both of which are disposed adjacent to each other and deposited on the insulating layer 9, the plurality of the first address electrodes 1 which cross the plurality of second address electrodes 2' through the insulating layer 9 and the partition 6, the spacer 8 which has the plurality of apertures respectively corresponding to the plurality of apertures formed by the plurality of first address electrodes 1 and the plurality of second electrodes 2' and in which the fluorescent layer 7 is deposited on the inner walls of the plurality of apertures, and the common electrode (display anode) 5. The plural pairs of first and second memory electrodes 2, 2' both of which are disposed adjacent to each other and deposited on the insulating layer 9, the plurality of first address electrodes 1, the spacer 8 and the common electrode (display anode) 5 are successively laminated and sealed into the tube body having the discharge gas. Therefore, the memory discharge and the main discharge, i.e., the discharge which contributes to the display carried out by the light emission can be separated with a simple arrangement and a simple drive circuit. Thus, the reset discharge is prevented from influencing the display carried out by the light emission and the contrast is improved drastically. The efficiency of the light emission and the luminance can be drastically improved without any influence on the screen operation carried out by both of the address discharge and the memory discharge.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the novel concepts of the present invention as defined in the appended claims.

What is claimed is:

1. A Discharge display apparatus comprising:

a plurality of first address electrodes and a plurality of second address electrodes both of which are disposed adjacent to each other so as to cross each other through a partition;

a memory electrode which has a plurality of apertures provided therethrough and is entirely covered with an insulating layer; and a tube body formed of a front glass plate and a rear glass plate, peripheries of said front glass plate and said rear glass plate being sealed by a frit glass to form a discharge space which is vacuumed and then into which a discharge gas sealed; said plurality of first and second address electrodes and said memory electrode being laminated and sealed into said tube body in this order.

2. A discharge display apparatus according to claim 1, wherein the plurality of apertures of said memory electrode are opposed to each of lattice apertures formed by said plurality of first and second electrodes.

3. The discharge display apparatus according to claim 2, wherein said plurality of first and second address electrodes are deposited on upper and lower surfaces of insulating layers.

4. A discharge display apparatus according to claim 1, wherein said plurality of first and second address electrodes are deposited on upper and lower surfaces of insulating layers.

5. A discharge display apparatus comprising:

a plurality of first address electrodes and a plurality of second address electrodes both of which are disposed adjacent to each other so as to cross each other through a partition;

a memory electrode which has a plurality of apertures provided therethrough and is entirely covered with an insulating layer;

a spacer which has a plurality of apertures respectively corresponding to the plurality of apertures of said memory electrode and in which a fluorescent layer is deposited on inner walls of said plurality of apertures of said memory electrode and said spacer;

a display electrode common to all of said apertures of said memory electrode and said spacer; and a tube body formed of a front glass plate and a rear glass plate, peripheries of said front glass plate and said rear glass plate being sealed by a frit glass to form a discharge space which is vacuumed and then into which a discharge gas sealed; said plurality of first and second address electrodes, said memory electrode, said spacer and said display electrode being successively laminated and sealed into said tube body in this order, said fluorescent layer being activated by ultraviolet rays generated by gas discharge in said discharge space.

6. The discharge display apparatus according to claim 5, wherein the plurality of apertures of said memory electrode are opposed to each of lattice apertures formed by said plurality of first and second electrodes.

7. The discharge display apparatus according to claim 5, wherein said plurality of first and second address electrodes are deposited on upper and lower surfaces of insulating layers.

8. A discharge display apparatus comprising:

a plurality of first address electrodes and a plurality of second address electrodes both of which are disposed adjacent to each other so as to cross each other through a partition;

a memory electrode which has a plurality of apertures respectively corresponding to the plurality of apertures of said memory electrode and in which a fluorescent layer is deposited on a surface on the opposite side of said memory electrode;

a display electrode common to all of said apertures of said memory electrode and said spacer; and a tube body formed of a front glass plate and a rear glass plate, peripheries of said front glass plate and said rear glass plate being sealed by a frit glass to form a discharge space which is vacuumed and then into which a discharge gas sealed; said plurality of first and second address electrodes, said memory electrodes, said spacer and said display electrode being successively laminated and sealed into said tube body in this order, said fluorescent layer being activated by ultraviolet rays generated by gas discharge in said discharge space.

9. The discharge display apparatus according to claim 8, wherein the plurality of apertures of said memory electrode are opposed to each of lattice apertures formed by said plurality of first and second electrodes.

10. The discharge display apparatus according to claim 8, wherein said plurality of first and second address electrodes are deposited on upper and lower surfaces of insulating layers.

11. A discharge display apparatus, comprising:

plural pairs of first memory electrodes and second memory electrodes which are disposed adjacent to each other and covered by an insulating layer, said second memory electrodes serving as second address electrodes;

a plurality of first address electrodes which cross said plurality of second address electrodes through said insulating layer and apartition;

a spacer which has a plurality of apertures respectively corresponding to a plurality of apertures formed by said plurality of first and second electrodes and in which a fluorescent layer is deposited on inner walls of said plurality of apertures;

a display electrode common to all of said apertures of said memory electrode and said spacer, and a tube body formed of a front glass plate and a rear glass plate, peripheries of said front glass plate and said rear glass plate being sealed by a frit glass to form a discharge space which is vacuumed and then into which a discharge gas sealed; said plural pairs of first and second memory electrodes both of which are disposed adjacent to each other and deposited on said insulating layer, said plurality of first address electrodes, said spacer and said display electrode being successively laminated and sealed into said tube body in this order, said fluorescent layer being activated by ultraviolet rays generated by gas discharge in said discharge space.

* * * * *